United States Patent [19]

Kobayashi et al.

[11] Patent Number: 4,923,783

[45] Date of Patent: May 8, 1990

[54] SILVER HALIDE PHOTOGRAPHIC MATERIALS AND METHOD OF PROCESSING THE SAME

[75] Inventors: Hidetoshi Kobayashi; Hideaki Naruse, both of Kanagawa, Japan

[73] Assignee: Fuji Photo Film Co., Ltd., Kanagawa, Japan

[21] Appl. No.: 257,893

[22] Filed: Oct. 14, 1988

[30] Foreign Application Priority Data

Oct. 14, 1987 [JP] Japan ..... 62-259112

[51] Int. Cl.[5] ..... G03C 7/16; G03C 7/32

[52] U.S. Cl. ..... 430/377; 430/222; 430/383; 430/546; 430/553; 430/635

[58] Field of Search ..... 430/546, 222, 553, 635, 430/377, 380, 383; 252/364

[56] References Cited

U.S. PATENT DOCUMENTS

| | | | |
|---|---|---|---|
| 4,555,470 | 11/1985 | Sakaguchi et al. | 430/222 |
| 4,745,047 | 5/1988 | Asami et al. | 430/567 |
| 4,745,049 | 5/1988 | Ohbayashi et al. | 430/546 |
| 4,767,697 | 8/1988 | Umemoto et al. | 430/546 |
| 4,783,394 | 11/1988 | Hirose et al. | 430/377 |
| 4,795,696 | 1/1989 | Sasaki et al. | 430/546 |
| 4,840,878 | 6/1989 | Hirose et al. | 430/377 |
| 4,851,326 | 7/1989 | Ishikawa et al. | 430/377 |

*Primary Examiner*—Hoa V. Le

*Attorney, Agent, or Firm*—Sughrue, Mion, Zinn, Macpeak & Seas

[57] ABSTRACT

A silver halide photographic material comprising a support having thereon at least one hydrophilic colloid layer containing at least one high boiling point organic solvent and at least one substantially water-insoluble photographically useful reagent both dispersed therein, wherein at least one of the high boiling point organic solvents is a compound represented by formula (I):

$$(ArCOO)_n—L \quad (I)$$

(the symbols of which are described herein).

By incorporation of a compound of formula (I), reductive fading of cyan dyes formed in the material due to heat, moisture is minimized.

A method of processing the silver halide photographic material as imagewise exposed with a color developer containing substantially no benzyl alcohol is also disclosed.

14 Claims, No Drawings

SILVER HALIDE PHOTOGRAPHIC MATERIALS AND METHOD OF PROCESSING THE SAME

FIELD OF THE INVENTION

The present invention relates to a silver halide photographic material and, more particularly, to that having a substantially water-insoluble photographic reagent dispersed in a hydrophilic organic colloid layer thereof by the aid of an aromatic carboxylic acid ester of a polyhydric alcohol.

BACKGROUND OF THE INVENTION

In the manufacture of conventional silver halide photographic materials, photographically useful reagents which are substantially water-insoluble {for example, oil-soluble couplers, antioxidants to be used for prevention of color-fading, color-fogging or color-mixing (such as alkylhydroquinones, alkylphenols, chromans, coumarones), hardening agents, oil-soluble filter dyes, oil-soluble ultraviolet absorbents, oil-soluble brightening agents, DIR compounds (such as DIR hydroquinones, colorless DIR couplers), developing agents, color developing agents, DDR redox compounds, DDR couplers} are incorporated into the hydrophilic organic colloid layers (for example, light-sensitive emulsion layer, filter layer, backing layer, antihalation layer, interlayer, protective layer), whereupon the reagent is first dissolved in an appropriate oil-forming agent or a high boiling point solvent and the resulting solution is dispersed in a hydrophilic organic colloid, especially a gelatin solution, in the presence of a surfactant. As the high boiling point solvent, phthalic acid ester compounds and phosphoric acid ester compounds are advantageously used.

Phthalic acid ester compounds and phosphoric acid ester compounds have been the most widely used for this purpose, because they have excellent dispersant properties with respect to couplers, a high affinity for colloid layers such as gelatin, a favorable influence on the stability of the color images formed, the influence on the hue of the color images formed and the chemical stability in photographic materials, and additionally are easily and inexpensively available.

However, these known high boiling point organic solvents (for example, phthalic acid ester compounds and phosphoric acid ester compounds) have been found insufficient in terms of their capacity to prevent the color images from being faded or stained due to the effects of light, heat or humidity.

The high boiling point organic solvents used in photographic materials are required to have many requirements. For instance, they must be prepared easily and inexpensively, have excellent solubility and dispersion stability properties with respect to photographic reagents, have no adverse influence on the ease of development and photographic properties, have excellent stability and have no adverse effect on the environment, they must have excellent ability in preventing the color images formed from being faded and have excellent chemical stability.

At the current time, processing for development of photographic materials is being directed to rapid processing, simple processing, processing with small replenishment (including the amount of rinsing water) and dispersed processing, rather than central processing. Accordingly, the problem of reduction fading during bleaching or bleach-fixation of cyan dyes is being focused on. It is believed that the reduction fading is caused by reduction of the iron(III) ion complex into an iron(II) ion complex in the bleaching or bleach-fixation bath because of the developing agent as brought into the bath together with the photographic material being processed or by reduction of the cyan dye into a colorless leuco dye because of the iron(II) ion complex as increased by fatigue of the bleaching or bleach-fixing bath. Accordingly, the high boiling point organic solvents used in photographic materials have been further required to have an activity of inhibiting the reduction fading of cyan dyes.

JP-A-62-134642 (the term "JP-A" as used herein refers to a "published unexamined Japanese patent application") mentions phthalic acid esters having a bulky substituent in the ortho-position, and European Patent (EP) 228,064 A2 mentions phthalic acid esters of tertiary alcohols. Both references disclose that the respective solvents have an activity of inhibiting reduction fading of cyan dyes caused by iron(II) ion. The former is different from the present invention in that this does not use any benzoic acid esters but uses phenol esters and the latter is different from the present invention in that this uses esters of monohydric alcohols.

The compounds mentioned in the aforesaid two patent publications have an activity of inhibiting reduction fading of cyan dyes caused by iron(II) ion, but the activity has been found to be small and insufficient for photographic purpose. Accordingly, an extremely large amount of the compounds would have to be added in order to attain the desired effect and thus are not always commercially practical.

SUMMARY OF THE INVENTION

A first object of the present invention is to provide a silver halide photographic material in which the reduction fading of cyan dyes by iron(II) ion may noticeably and fully be inhibited and to provide a method of processing the material.

A second object of the present invention is to provide a silver halide photographic material capable of forming color images which are hardly faded or stained (especially in the white background part) by heat, light and humidity, and more specifically, a silver halide photographic material in which the yellow color image formed is hardly faded by light and the cyan color image formed is hardly faded by heat and humidity, as well as to provide a method of processing the said material.

The third object of the present invention is to provide a silver halide photographic material using a high boiling point organic solvent which is excellent in the solubility and dispersion stability of photographic reagents and to provide a method of processing the material.

In order to attain the above objects, the present invention provides a silver halide photographic material comprising a support having thereon at least one hydrophilic colloid layer containing at least one high boiling point organic solvent and at least one substantially water-insoluble photographically useful reagent both dispersed therein, in which at least one of the high boiling point organic solvents is a compound represented by general formula (I):

$$(ArCOO)_n—L \qquad (I)$$

wherein Ar represents an aryl group having from 6 to 24 carbon atoms; L represents a 2- to 6-valent alkylene group having from 2 to 24 carbon atoms provided that the alkylene group may contain one or more ether bonds; and n represents an integer of from 2 to 6.

The present invention further provides a method of processing the silver halide photographic material in which the material is, after being imagewise exposed, developed with a color developer substantially free of benzyl alcohol.

DETAILED DESCRIPTION OF THE INVENTION

The color developer for use in the present invention, substantially free of benzyl alcohol, means a color developer in which the content of benzyl alcohol is 2 ml (about 2.08 g) or less, preferably 1 ml of less, per liter of the developer at 25° C.

The compounds of formula (I) for use in the present invention may be considered to be aromatic carboxylic acid esters of polyhydric alcohols, and some compounds which are similar to them are known. For example, U.S. Pat. No. 3,748,141 mentions aliphatic carboxylic acid esters of cyclohexanediol or cyclohexanedimethanol; U.S. Pat. No. 3,936,303 discloses aliphatic carboxylic acid esters of glycerin; U.S. Pat. No. 4,004,928 discloses aliphatic carboxylic acid esters of dipentaerythritol; U.S. Pat. No. 4,080,209 mentions benzoic acid esters of monohydric alcohols; and JP-A-51-27921 discloses aliphatic carboxylic acid esters of 2,4-dimethylpentane-1,3-diol.

The compounds described in U.S. Pat. No. 4,080,209 are different from the compounds of the present invention in that the former are esters of monohydric alcohols; the compounds described in the other patent publications are also different from the compounds of the present invention in that the former are esters of aliphatic carboxylic acids. The compounds described in these patent publications are not sufficient in view of the potency of inhibiting the reduction fading of cyan dyes caused by iron(II) ion and also in view of the potency of inhibiting color images from being faded or stained by heat, light or humidity. This observation will be illustrated in the following examples.

The compounds of formula (I) for use in the present invention will now be explained in detail.

In formula (I), Ar represents an aryl group having from 6 to 24 total carbon atoms, which may optionally be substituted by an alkyl group (e.g., methyl, ethyl, isopropyl, sec-butyl, isobutyl, t-butyl, cyclopentyl, t-pentyl, cyclohexyl, t-hexyl, 2-ethylhexyl, 2-decyl, dodecyl, benzyl, trifluoromethyl, chloroethyl), an alkenyl group (e.g., vinyl, allyl, 2-methylallyl, cyclohexenyl, undecenyl, dodecenyl, oleyl), an aryl group (e.g., phenyl, p-tolyl), an alkoxy group (e.g., methoxy, ethoxy, butoxy, methoxyethoxy, benzyloxy, dodecyloxy, cyclohexyloxy), an aryloxy group (e.g., phenoxy, 2-phenylphenoxy, 4-methoxyphenoxy, 3-chlorophenoxy, 1-naphthoxy), a carbonamido group (e.g., acetamido, trifluoroacetamido, benzamido), a sulfonamido group (e.g., methanesulfonamido, toluenesulfonamido), an acyloxy group (e.g., acetoxy, benzoyloxy), a sulfonyl group (e.g., methylsulfonyl, phenylsulfonyl, p-tolylsulfonyl), a hydroxyl group and/or a halogen atom (e.g., fluorine, chlorine, bromine, iodine). Ar may also be an aryl group as condensed with benzene ring(s) and/or hetero ring(s), and examples of the condensed group include 1-naphthyl, 2-naphthyl and 8-quinolyl groups.

In formula (I), L represents a 2- to 6-valent alkylene group having from 2 to 24 carbon atoms or an alkylene group as bonded via an ether bond, which may optionally be substituted by a hydroxyl group, a halogen atom (e.g., fluorine, chlorine, bromine, iodine), an alkoxy group (e.g., methoxy, ethoxy, methoxyethoxy, butoxy, benzyloxy) and/or an alkoxycarbonyl group (e.g., methoxycarbonyl, ethoxycarbonyl). Specific examples of L include those represented by any one of the following formulae (I-1) through (I-9).

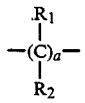

(I-1)

wherein $R_1$ and $R_2$ each independently represents a hydrogen atom or an alkyl group having from 1 to 12 carbon atoms; and a represents an integer of from 2 to 12; provided that $R_1$ and $R_2$ may be bonded together to form a cycloalkane, or plural

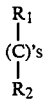

may be the same or different;

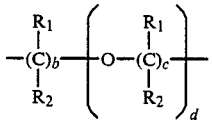

(I-2)

wherein

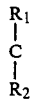

has the same meaning as defined in the formula (I-1); b and c each independently represents an integer of from 2 to 6; and d represents an integer of from 1 to 8;

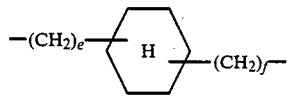

(I-3)

wherein

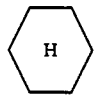

represents a cyclohexane ring; and e and f each independently represents an integer of from 0 to 4;

$$-(CH_2)_g-A-(CH_2)_h- \quad \text{(I-4)}$$

wherein A represents a hydrocarbon ring except cyclohexane (e.g., cyclopentane, cyclopentene, cyclohexene, norbornane, bicyclo[2,2,2]octane, norbronene, adamantane, epoxycyclohexane), which may optionally be substituted by an alkyl group having from 1 to 6 carbon atoms; and g and h each independently represents an integer of from 0 to 4;

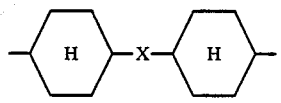
(I-5)

wherein

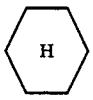

represents a cyclohexane ring; X represents

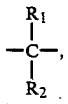

—O—, —$SO_2$—, —SO—, —S— or —CO—, provided that

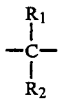

has the same meaning as

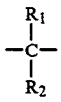

in formula (I-1);

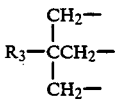
(I-6)

wherein $R_3$ represents a hydrogen atom, an alkyl group having from 1 to 6 carbon atoms or $ArCOOCH_2$— wherein Ar is the same as defined in formula (I), provided that one of the three bonds may be substituted by a hydroxyl group;

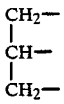
(I-7)

wherein one of the three bonds may optionally be substituted by a hydroxyl group;

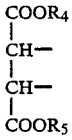
(I-8)

wherein $R_4$ and $R_5$ each independently represents an alkyl group having from 1 to 10 carbon atoms;

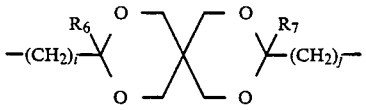
(I-9)

wherein $R_6$ and $R_7$ each independently represents a hydrogen atom or an alkyl group having from 1 to 6 carbon atoms; and i and j each independently represents an integer of from 1 to 6.

In formula (I-1) through (I-9), the alkyl group for $R_1$ to $R_7$ may be either linear or branched (for example, 2-ethylhexyl or isopropyl, as a branched alkyl group), and may optionally be substituted by one or more substituents selected from a halogen atom (e.g., chlorine, fluorine, bromine, iodine) and a hydroxyl group.

Specific examples of L are shown below, where —means a bond to ArCOO, and

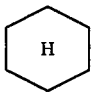

represents a cyclohexane ring. —$CH_2CH_2$—, —$CH_2CH_2CH_2$—, —$(CH_2)_4$—, —$(CH_2)_6$—,

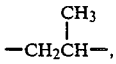

—$CH_2CH_2OCH_2CH_2$—, —$CH_2CH_2(OCH_2CH_2)_2$—, —$CH_2CH_2(OCH_2CH_2)_3$—, —$CH_2CH_2CH_2OCH_2CH_2CH_2$—,

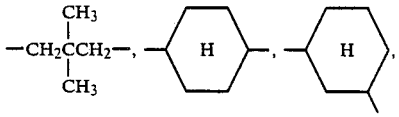

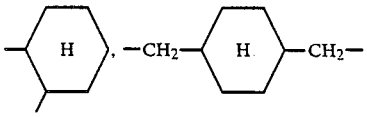

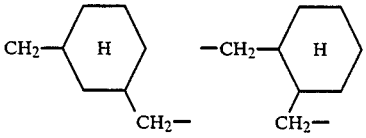

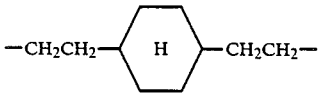

-continued

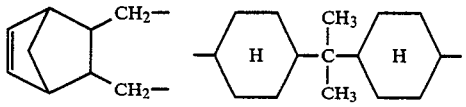

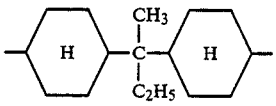

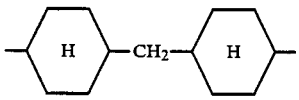

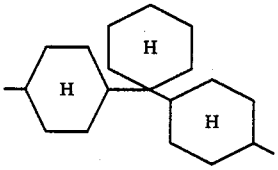

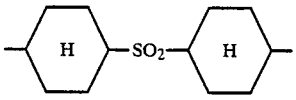

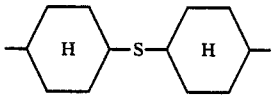

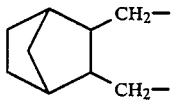

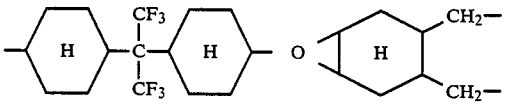

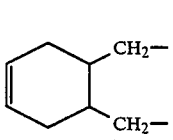

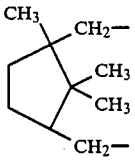

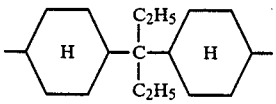

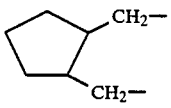

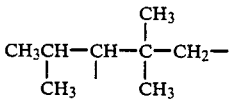

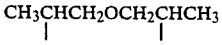

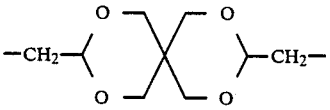

-continued

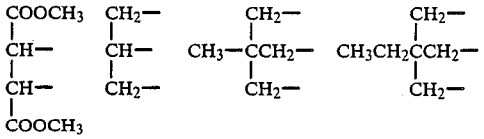

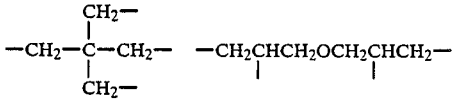

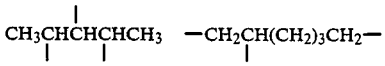

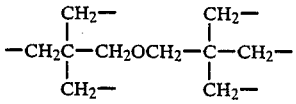

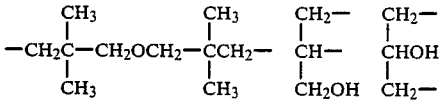

In formula (I), n represents an integer of from 2 to 6, which corresponds to the 2- to 6-valent of L. That is, when L is 4-valent, n is 4.

In the compounds represented by formula (I), Ar is preferably an unsubstituted phenyl group, a 1-naphthyl group or a 2-naphthyl group, or a phenyl group substituted by one or more substituents selected from an alkyl group, an alkoxy group and a halogen atom (e.g., p-tolyl, m-tolyl, o-tolyl, p-methoxyphenyl, 2,4-dichlorophenyl, p-t-butylphenyl, 2,4-dimethylphenyl, 2,6-dimethylphenyl, 3-chloro-4-methoxyphenyl), and more preferably is an unsubstituted phenyl group.

In the compounds of formula (I), L is preferably represented by any one of the aforesaid formula (I-3), (I-4), (I-5), (I-6) and (I-9), and specific examples thereof are shown below.

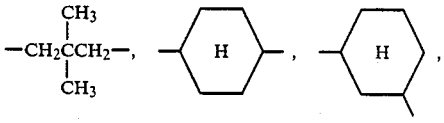

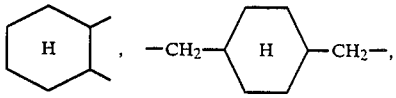

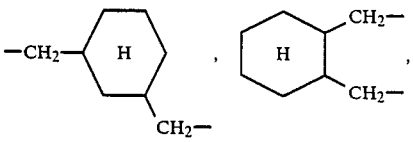

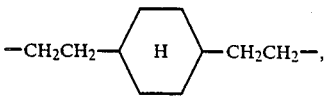

-continued
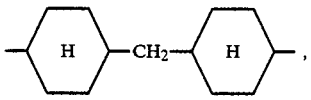
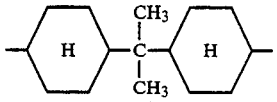
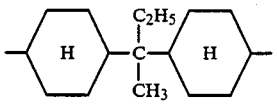
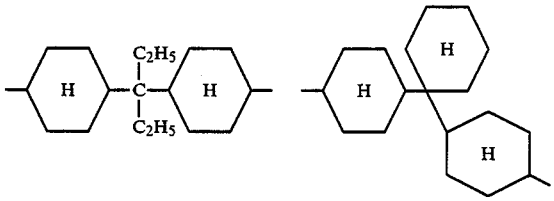
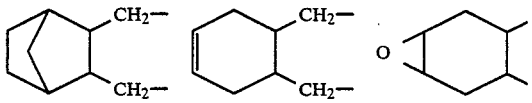
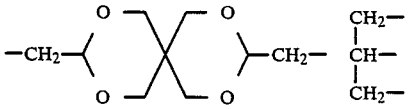
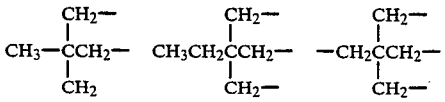
More preferably, L is represented by any one of formula (I-4), (I-5), (I-6) and (I-9), and specific examples thereof are as follows:
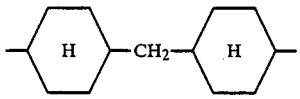
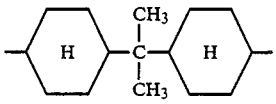
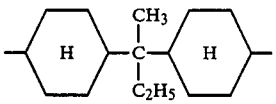
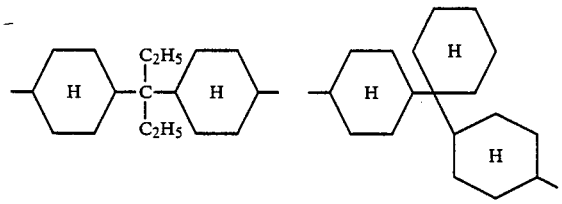
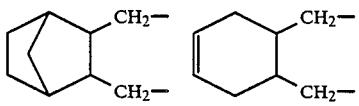
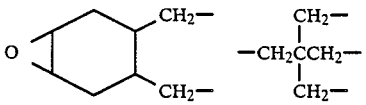
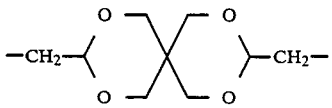
In formula (I), n is preferably from 2 to 4 and is more preferably 2.
Specific examples of the compounds of formula (I) for use in the present invention are shown below; however, the scope of the present invention is not restricted to these compounds.
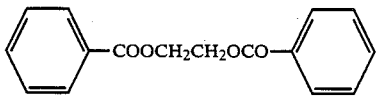
(I-1)
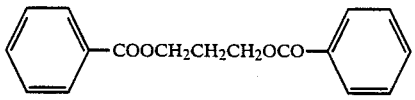
(I-2)
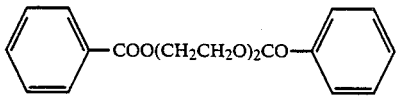
(I-3)
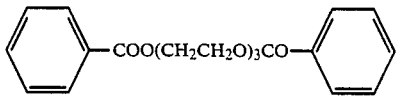
(I-4)

-continued
(I-5)
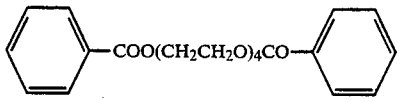
(I-6)
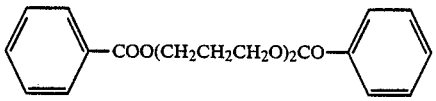
(I-7)
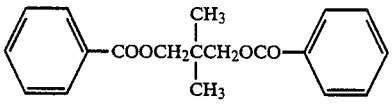
(I-8)
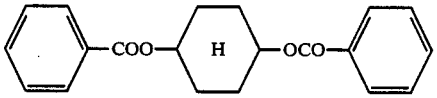
(I-9)
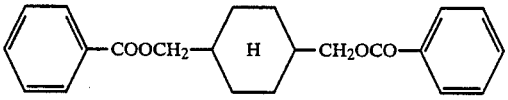
(I-10)
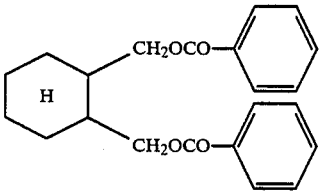
(I-11)
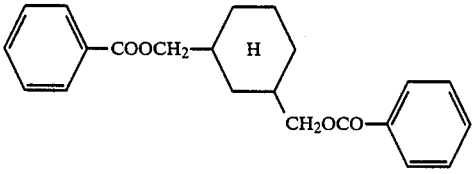
(I-12)
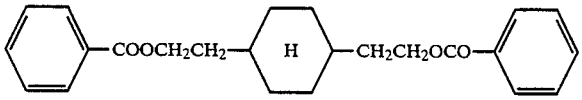
(I-13)
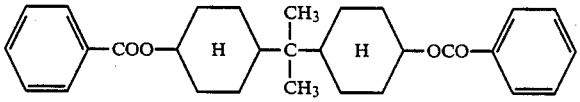
(I-14)
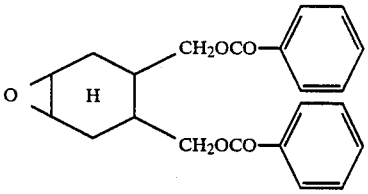
(I-15)
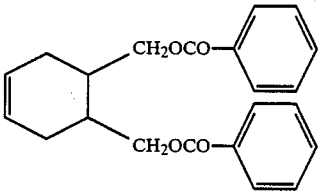

-continued
(I-16)
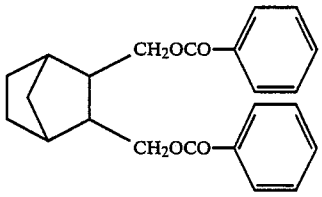
(I-17)
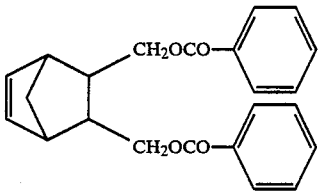
(I-18)
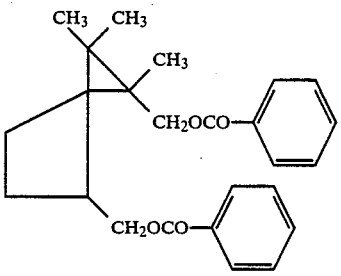
(I-19)
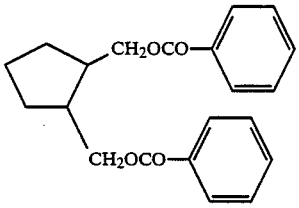
(I-20)
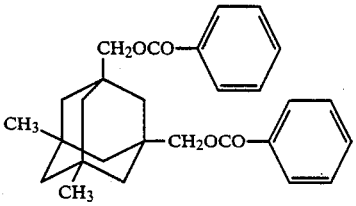
(I-21)
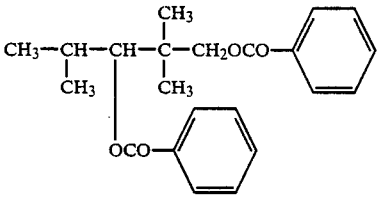
(I-22)
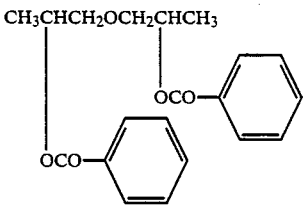

-continued
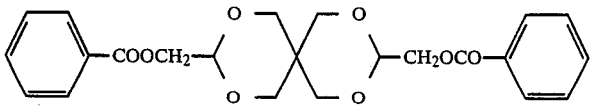
(I-23)
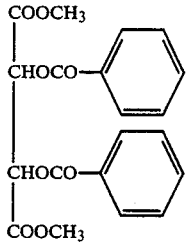
(I-24)
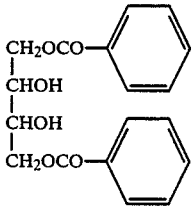
(I-25)
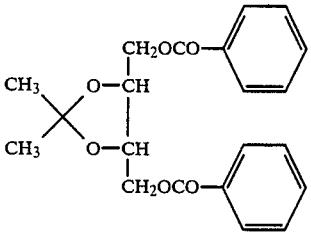
(I-26)
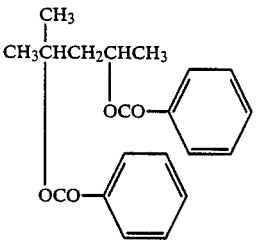
(I-27)
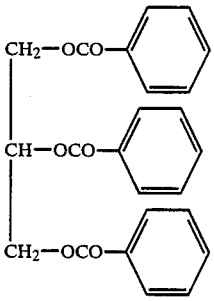
(I-28)

-continued
(I-29)
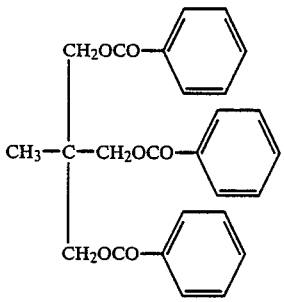
(I-30)
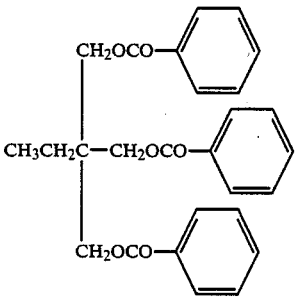
(I-31)
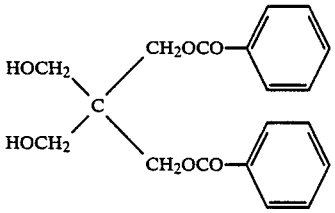
(I-32)
$ROCH_2CH(OR)CH_2OCH_2CH(OR)CH_2OR$
R represents —CO— 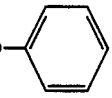
(I-33)
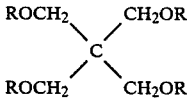
R represents —CO— 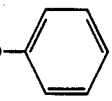
(I-34)
$CH_3CH(OR)CH(OR)CHCH_3$
R represents —CO— 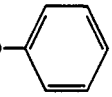
(I-35)
$ROCH_2CH(OR)(CH_2)_3CH_2OR$ -continued
R represents —CO—
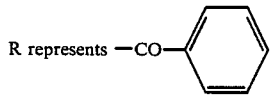
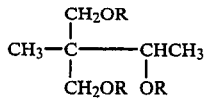
(I-36)
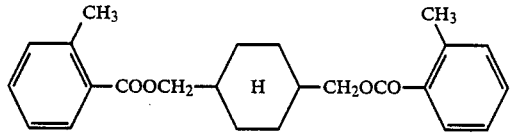
(I-37)
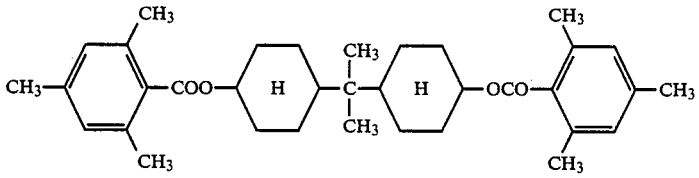
(I-38)
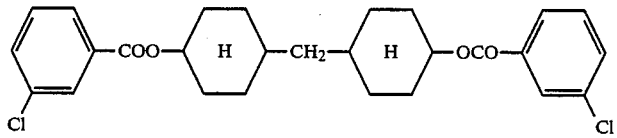
(I-39)
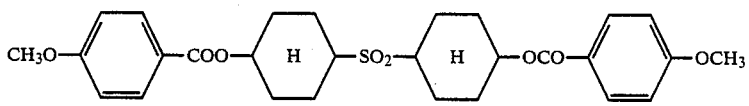
(I-40)
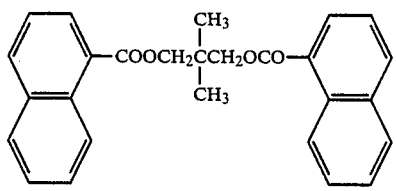
(I-41)
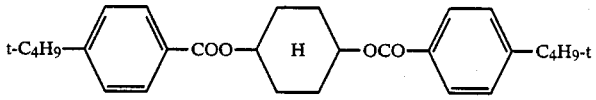
(I-42)
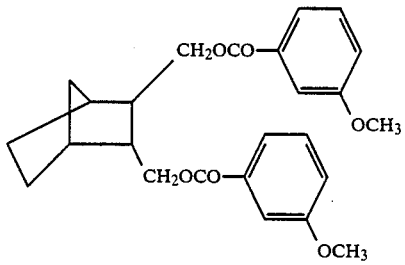
(I-43)
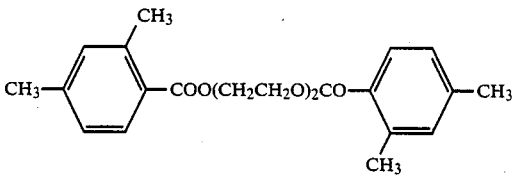
(I-44)

-continued
(I-45)
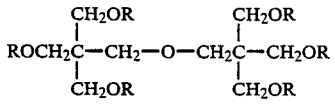
(I-46)
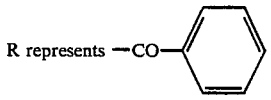
(I-47)
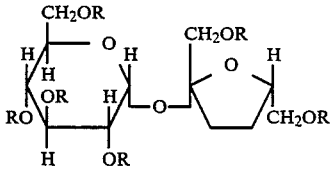
(I-48)
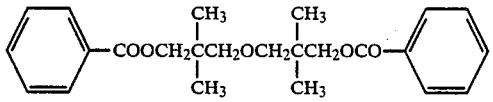
(I-49)
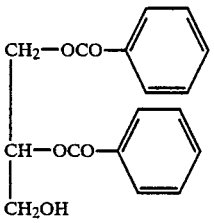
(I-50)
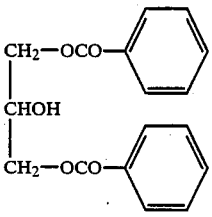
(I-51)
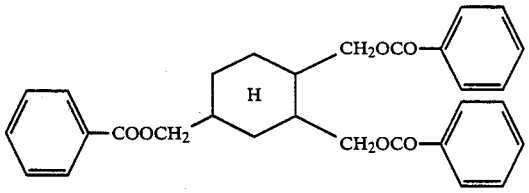
(I-52)
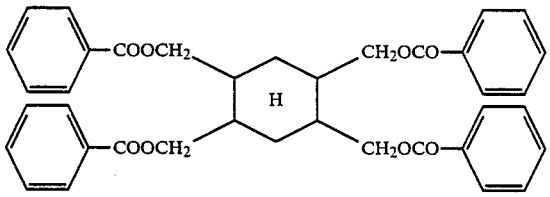
(I-53)
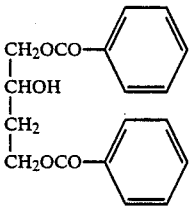

The compounds of formula (I) can be produced by condensation reaction of a polyhydric alcohol compound and an aromatic carboxylic acid, aromatic carboxylic acid anhydride or aromatic carboxylic acid chloride. Above all, aromatic carboxylic acid chlorides are most generally used, and a base (e.g., sodium carbonate, potassium carbonate, pyridine, tetramethylguanidine, triethylamine) is generally used for the reaction. As a solvent, benzene, toluene, methylene, chloroform, dichloroethane, acetonitrile, tetrahydrofuran, dioxane, dimethylformamide or dimethylacetamide is generally used.

An example which illustrates the synthesis of a compound of formula (I) is described below.

PRODUCTION EXAMPLE

Production of Compound (I-13)

24.0 g of 2,2-bis(4-hydroxy-1-cyclohexyl)propane and 19.8 g of pyridine were dissolved in 200 ml of dichloroethane, and 28.1 g of benzoyl chloride were dropwise added thereto with stirring at room temperature. After the addition, the resultant solution was stirred for an additional 3 hours at 50° C. and then cooled to room temperature, and the reaction solution was washed three times, each with 300 ml of water. The resulting dichloroethane solution was concentrated under reduced pressure, and toluene was added to the residue for crystallization to obtain 40.8 g of Compound (I-13). The yield was 91%, and the compound had a melting point of from 193° C. to 196° C.

In the same manner, Compound (I-7) (m.p. 49° C.), Compound (I-8) (m.p. 112.5° to 115° C.), Compound (I-9) (m.p. 123.5° to 126° C.), Compound (I-28) (m.p. 71° C.), Compound (I-29) (m.p. 81° C.) and Compound (I-33) (m.p. 99° C.) were prepared. The other compounds of formula (I) may also be prepared in the same manner.

The amount of the compound of formula (I) for use in the present invention depends upon the physical and chemical properties of the photographically useful reagent to be used therewith. In many cases, it may freely be varied within the range of from 1 to 200% by weight based on the weight of the photographically useful reagent which exists in the same colloid layer containing the compound of formula (I). Preferably, the compound of formula (I) is used under the condition whereby the compound and the photographically useful reagent may be uniformly dispersed in a compatible state. The compound of formula (I) can be added to hydrophilic organic colloid layers of photographic materials, together with a photographically useful reagent, by an oil-in-water dispersion method or the like. In accordance with this method, a photographically useful reagent is dissolved in the high boiling point organic solvent, optionally together with a low boiling point auxiliary solvent, and the resulting solution is finely dispersed in an aqueous medium such as water or an aqueous gelatin solution in the presence of a surface active agent. The dispersion may optionally be accompanied by phase inversion. If desired, the auxiliary solvent may be removed or reduced by distillation, noodle washing or ultrafiltration prior to coating.

The compounds of formula (I) may be used singly or in a combination of two or more, whereupon any other known high boiling point organic solvent may optionally be used therewith in an amount of 50% by weight or less.

The substantially water-insoluble photographically useful reagent for use in the present invention includes any and every photographically useful reagent which has heretofore been known and which may be dispersed in a hydrophilic colloid layer with conventional high boiling point organic solvents.

Specific examples include photographic couplers (e.g., yellow couplers, magenta couplers, cyan couplers, black-coloring couplers, colorless couplers), antioxidants or antifading agents for inhibiting color-fogging or fading of colored images (e.g., alkylhydroquinones and their mono- or dialkyl ethers, alkylphenols, chromans, coumarans, hindered amines, transition metal complexes), hardening agents, oil-soluble filter dyes, oil-soluble antihalation dyes, oil-soluble ultraviolet absorbents, brightening agents, DIR compounds (e.g., DIR couplers, DIR hydroquinones), developing agents, DDR couplers, DRR compounds, color developing agents, development inhibitors and their precursors, development accelerators and their precursors, etc.

The reagent is dispersed in a compound of formula (I) and the resulting dispersion may be incorporated into the hydrophilic organic colloid layers of a photographic material, and additionally, it is preferred that a photographic coupler dispersed in a compound of formula (I) is also incorporated into a light-sensitive silver halide emulsion layer of the photographic material.

The photographic couplers which may be applied to the present invention include compounds which may be reacted or coupled with the oxidation product of an aromatic primary amine developing agent (e.g., phenylenediamine derivatives, aminophenol derivatives) in color development. For example, as magenta couplers, there are 5-pyrazolone couplers, pyrazolotriazole couplers, pyrazolobenzimidazole couplers, cyanoacetylcoumarone couplers and ring-opened acylacetonitrile couplers; as yellow couplers, there are acylacetamide couplers (e.g., benzoylacetanilide couplers, pivaloylacetanilide couplers) and malondiamide couplers; and as cyan couplers, there are naphthol couplers and phenol couplers.

Specific examples of cyan, magenta and yellow couplers which may be used in the present invention are described in the patent publications as referred to in *Research Disclosure,* (RD) No. 17643 (December, 1978), VII-D and No. 18717 (November, 1979).

The couplers are preferably nondiffusible as having a ballast group or being polymerized. The coupling position is preferably substituted by a releasing group rather than a hydrogen atom. Couplers capable of forming a colored dye with an appropriate diffusibility, colored couplers, colorless couplers as well as couplers capable of releasing a development inhibitor or development accelerator with coupling reaction may also be used in the present invention.

As yellow couplers which may be used in the present invention, there are oil-protective type acylacetamide couplers as typical examples. Specific examples of the couplers are described in U.S. Pat. Nos. 2,407,210, 2,875,057 and 3,265,506. 2-Equivalent yellow couplers are preferably used in the present invention, and the oxygen atom-releasing type yellow couplers described in U.S. Pat. Nos. 3,408,194, 3,447,928, 3,933,501 and 4,401,752 as well as the nitrogen atom-releasing type yellow couplers described in JP-B-58-10739 (the term "JP-B" as used herein refers to an "examined Japanese patent publication"), U.S. Pat. Nos. 4,022,620 and 4,326,024, RD No. 18053 (April, 1979), British Patent 1,425,020 and West German Patent Applications (OLS) 2,219,917, 2,261,361, 2,329,587 and 2,433,812 are mentioned as typical examples of the couplers. α-Pivaloylacetanilide couplers are characterized by the fastness of the color dyes formed therefrom, while α-benzoylacetanilide couplers are characterized by the excellent coloring capacity.

As magenta couplers which may be used in the present invention, there are oil-protective type indazolone or cyanoacetyl couplers, preferably 5-pyrazolone couplers and pyrazoloazole couplers such as pyrazolotriazoles. 5-pyrazolone couplers are preferably those substituted by an arylamino group of an acylamino group on the 3-position thereof in view of the hue of the dye to be formed therefrom as well as of the coloring speed of the coupler. Specific examples of the preferred couplers are described in U.S. Pat. Nos. 2,311,082, 2,343,703, 2,600,788, 2,908,573, 3,062,653, 3,152,896 and 3,936,015. 2-Equivalent 5-pyrazolone couplers are also preferred, and as the releasing group for the couplers, the nitrogen atom-releasing group described in U.S. Pat. No. 4,310,619 and the arylthio group described in U.S. Pat. No. 4,351,897 are preferred. The ballast group-containing 5-pyrazolone couplers described in European Patent 73,636 have a high coloring reactivity.

As pyrazoloazole couplers for use in the present invention, there may be mentioned, for example, the pyrazolo[1,5-b][1,2,4]triazoles described in European Patent 119,860, the pyrazolobenzimidazoles described in U.S. Pat. No. 3,369,897, and preferably the pyrazolotetrazoles described in RD No. 24220 (June, 1984) and the pyrazolopyrazoles described in RD No. 24230 (June, 1984). The imidazopyrazoles described in JP-A-59-162548 and the aforesaid pyrazolo[1,5-b][1,2,4]triazoles are most preferred because of the small yellow side-absorption of the color dyes formed and the light fastness thereof.

As cyan couplers which may be used in the present invention, there are oil-protective type naphthol couplers and phenol couplers as typical examples. Specific examples of the couplers are the naphthol couplers described in U.S. Pat. No. 2,474,293 and preferably the oxygen atom-releasing type highly active 2-equivalent naphthol couplers described in U.S. Pat. Nos. 4,052,212, 4,146,396, 4,228,233 and 4,292,200. Specific examples of phenol couplers are described in U.S. Pat. Nos. 2,369,929, 2,423,730, 2,772,162, 2,801,171 and 2,895,826.

Cyan couplers which are fast to heat, humidity and temperature are preferably used in the present invention, and specific examples thereof include the phenol cyan couplers described in U.S. Pat. No. 3,772,002, the 2,5-diacylamino-substituted phenol couplers described in U.S. Pat. Nos. 2,772,162, 3,758,308, 4,126,396, 4,334,011 and 4,327,173, West German Patent Application (OLS) 3,329,729 and JP-A-59-166956, and the phenol couplers having a phenylureido group at the 2-position and an acylamino group at the 5-position described in U.S. Pat. Nos. 3,446,622, 4,333,999, 4,451,559 and 4,427,767.

In order to correct the unnecessary absorption in the short wavelength range of the color dyes formed from magenta couplers or cyan couplers, colored couplers are preferably used in picture-taking color photographic materials. As typical examples of the colored couplers for this purpose, there may be mentioned the yellow-colored magenta couplers described in U.S. Pat. No. 4,163,670 and JP-B-57-39413, and the magenta-colored cyan couplers described in U.S. Pat. Nos. 4,004,929 and 4,138,258 and British Patent 1,146,368.

These color couplers may be in the form of a dimer or a higher polymer. Specific examples of polymerized couplers are described in U.S. Pat. Nos. 3,451,820 and 4,080,211. Specific examples of polymerized magenta couplers are described in British Patent 2,102,173 and U.S. Pat. No. 4,367,282.

In the present invention, by using couplers giving colored dyes having a proper diffusibility together with the aforesaid color couplers, the graininess of color images formed can be improved. Specific examples of magenta couplers of this type are described in U.S. Pat. No. 4,366,237 and British Patent 2,125,570 and specific examples of yellow, magenta and cyan couplers of this type are described in European Patent 96,873 and West German Patent Application (OLS) 3,324,533.

Two or more kinds of the above-mentioned couplers may be incorporated into the same layer of a photographic material to satisfy the necessary characteristics of the materials, or alternatively, the same coupler may be incorporated into two or more different layers of a photographic material with no problem.

The couplers may be dispersed by the use of a compound of formula (I) of the present invention, but, if desired, these may also be dispersed in a mixed solvent comprising a compound of formula (I) and any other known high boiling point organic solvent. Alternatively, the couplers may separately previously be dispersed in a known high boiling point organic solvent and then combined with a compound of formula (I) of the present invention.

As specific examples of high boiling point organic solvents which may be used together with compounds of formula (I) of the present invention, there may be mentioned phthalic acid esters (e.g., dibutyl phthalate, dicyclohexyl phthalate, di-2-ethylhexyl phthalate, didodecyl phthalate), phosphoric acid or phosphonic acid esters (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylheyxlphenyl phosphonate), benzoic acid esters (e.g., 2-ethylhexyl benzoate, dodecyl benzoate, 2-ethylhexyl p-hydroxybenzoate), amides (e.g., diethyldodecanamide, N-tetradecylpyrrolidone), alcohols or phenols (e.g., isostearyl alcohol, 2,4-di-tert-amylphenol), aliphatic carboxylic acid esters (e.g., dioctyl azelate, dioctyl sebacate, glycerol tributyrate, isostearyl lactate, trioctyl citrate), aniline derivatives (e.g., N,N-dibutyl-2-butoxy-5-tert-octylaniline), hydrocarbons (e.g., paraffin, chloroparaffin, dodecylbenzene, diisopropylnaphthalene), etc.

Couplers which may especially preferrably be used together with compounds of formula (I) of the present invention are those mentioned in detail hereunder.

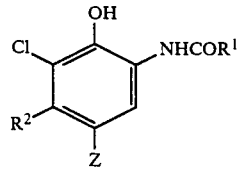

(II)

wherein $R^1$ represents an aliphatic group, an aromatic group or a heterocyclic group; $R^2$ represents an alkyl group having from 1 to 15 carbon atoms; and Z represents a hydrogen atom or a group or atom capable of being released by coupling reaction with a developing agent.

$R^1$, $R^2$ and Z in the formula (II) will now be described in greater detail.

The "aliphatic group" as referred to herein means a linear, branched or cyclic aliphatic hydrocarbon group, which includes a saturated group or an unsaturated group such as an alkyl group, an alkenyl group or an alkynyl group and which may be further substituted by substituent(s). Specific examples of these groups include methyl, ethyl, butyl, dodecyl, octadecyl, eicosenyl, iso-propyl, tert-butyl, tert-octyl, tert-dodecyl, cyclohexyl, cyclopentyl, allyl, vinyl, 2-hexadecenyl and propargyl groups and substituted groups thereof.

The "aromatic group and heterocyclic group" as referred to herein also mean those in which the unsaturated ring or saturated ring may optionally be substituted.

In formula (II), $R^1$ represents an aliphatic group preferably having from 1 to 36 carbon atoms, an aromatic group preferably having from 6 to 36 carbon atoms (e.g., phenyl, naphthyl), a heterocyclic group (e.g., 3-pyridyl, 2-furyl), or an aromatic or heterocyclic amino group (e.g., anilino, naphthylamino, 2-benzothiazolylamino, 2-pyridylamino), and the groups may further be substituted by substituent(s) selected from an alkyl group, an aryl group, a heterocyclic group, an alkoxy group (e.g., methoxy, 2-methoxyethoxy), an aryloxy group (e.g., 2,4-di-tert-amylphenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy, an amido group (e.g., acetylamino, ethylcarbamoyl, dimethylcarbamoyl, methanesulfonamido, butylsulfamoyl), a sulfamido group (e.g., dipropylsulfamoylamino), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxyl group, a cyano group, a carboxyl group, a nitro group, a sulfo group and a halogen atom.

In formula (II), $R^2$ represents an alkyl group having from 1 to 15 carbon atoms, which may be linear, branched or cyclic and which may have substituent(s).

In formula (II), Z represents a hydrogen atom or a coupling-releasing group. Examples of the group include a halogen atom (e.g., fluorine, chlorine, bromine); an alkoxy group (e.g., ethoxy, dodecyloxy, methoxyethylcarbamoylmethoxy, carboxypropyloxy, methylsulfonylethoxy); an aryloxy group (e.g., 4-chlorophenoxy, 4-methoxyphenoxy, 4-carboxyphenoxy); an acyloxy group (e.g., acetoxy, tetradecanoyloxy, benzoyloxy); a sulfonyloxy group (e.g., methanesulfonyloxy, toluenesulfonyloxy); a amido group (e.g., dichloroacetylamino, heptafluorobutyrylamino, methanesulfonylamino, toluenesulfonylamino); an alkoxycarbonyloxy group (e.g., ethoxycarbonyloxy, benzyloxycarbonyloxy); an aryloxycarbonyloxy group (e.g., phenoxycarbonyloxy); an aliphatic or aromatic thio group (e.g., ethylthio, phenylthio, tetrazolylthio); an imido group (e.g., succinimido, hydantoinyl); an aromatic azo group (e.g., phenylazo); etc. These releasing groups may optionally contain a photographically useful group.

As the photographically useful group, there may be mentioned, for example, a development inhibitor-containing group and a development accelerator-containing group.

In formula (II), $R^1$ may form a dimer or a higher polymer.

In formula (II), $R^1$ is preferably a substituted or unsubstituted alkyl group having carbon atoms enough to render the coupler difficultly diffusible in a hydrophilic colloid layer (i.e., a total of 8 or more carbon atoms). More preferably, it represents an alkyl group having 8 or more carbon atoms, and most preferably it represents a linear unsubstituted alkyl group having from 12 to 18 carbon atoms.

In formula (II), $R^2$ is preferably an alkyl group having from 1 to 4 carbon atoms and is most preferably a methyl group or an ethyl group.

In formula (II), Z is preferably a hydrogen atom or a halogen atom, and more preferably a chlorine or bromine atom.

Specific examples of the cyan couplers of formula (II) are mentioned below, which, however, are not limitative.

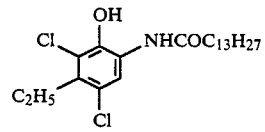

(II-1)

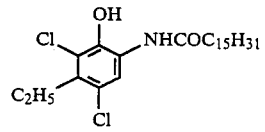

(II-2)

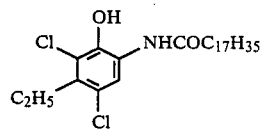

(II-3)

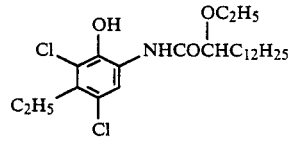

(II-4)

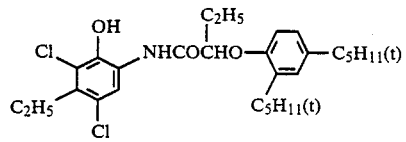

(II-5)

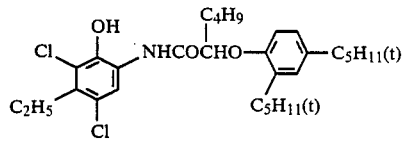

(II-6)

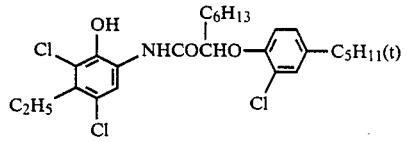

(II-7)

-continued (II-8)

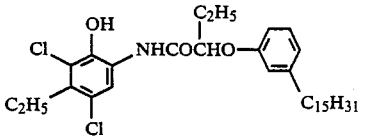

(II-9)

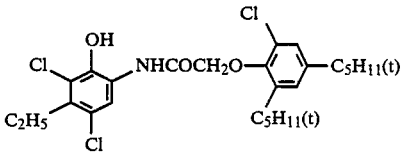

(II-10)

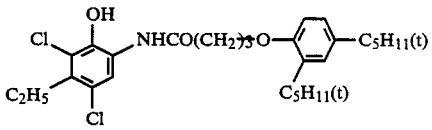

(II-11)

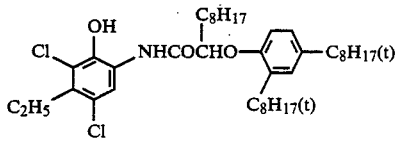

(II-12)

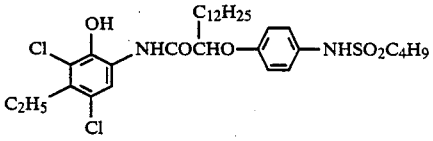

(II-13)

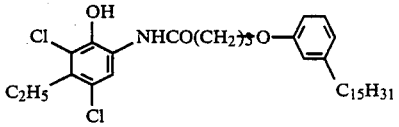

(II-14)

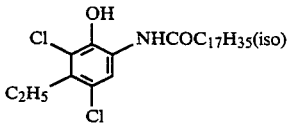

(II-15)

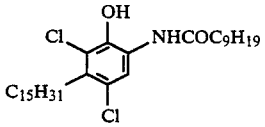

(II-16)

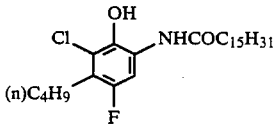

(II-17)

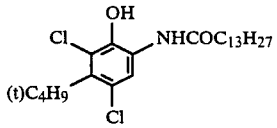

(II-18)

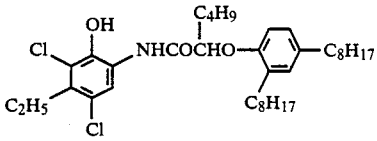

-continued (II-19)

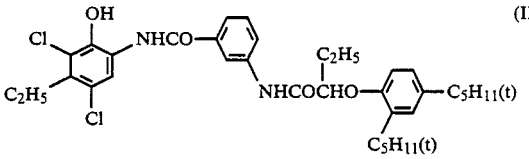

(II-20)

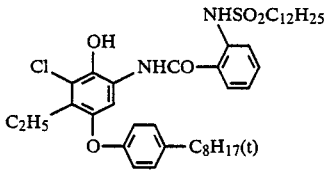

(II-21)

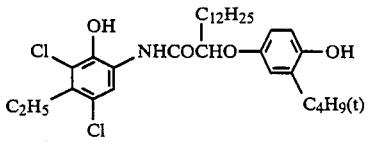

(II-22)

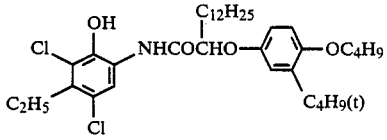

(II-23)

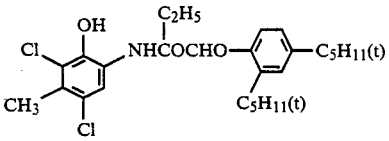

(II-24)

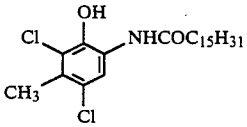

In accordance with the present invention, two or more kinds of the cyan couplers of formula (II) may be incorporated into a photographic material, or any other known cyan coupler may be incorporated into the layer containing the cyan coupler of formula (II) or into any other layer. As other cyan couplers which may preferably be used in the present invention than the cyan couplers of the formula (II), those represented by the following formula (III) may be mentioned.

(III)

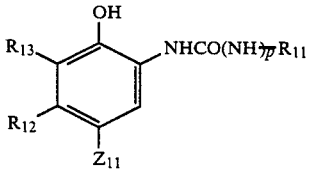

wherein $R_{11}$ represents an aliphatic group, an aromatic group or a heterocyclic group; $R_{12}$ represents a methyl group or an acylamino group; $R_{13}$ represents a hydrogen atom, a halogen atom, an aliphatic group, an aromatic group, an aliphatic or aromatic oxy group, or an acylamino group, further provided that $R_{12}$ may be bonded to $R_{13}$ to form a 5- to 7-membered ring; $Z_{11}$ represents a hydrogen atom or a group or atom capable of being released by oxidative coupling reaction with a developing agent; p represents 0 or 1;

Specific examples of the cyan couplers of formula (III) are illustrated below.

The meanings of the "aliphatic group", "aromatic group" and "heterocyclic group" for the definition of $R_{11}$ are the same as those of $R_1$ in formula (II), and the examples for $R_1$ described hereinbefore are applied as the examples for $R_{11}$. As the examples for $Z_{11}$, the examples for Z in formula (II) described hereinbefore are applied. $R_{12}$ and $R_{13}$ are described in detail in U.S. Pat. Nos. 2,895,826, 4,557,999, 4,565,777, 4,124,396 and 4,613,564. The rings formed with $R_{12}$ and $R_{13}$ are described in detail in U.S. Pat. Nos. 4,327,173, 4,564,586 and 4,430,423.

(C-1)

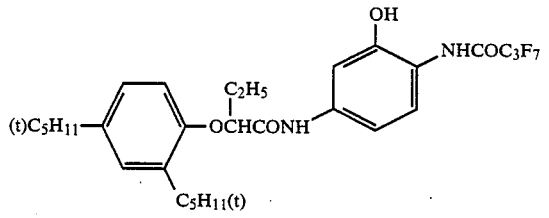

(C-2)

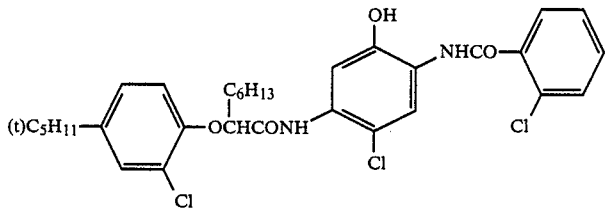

(C-3)

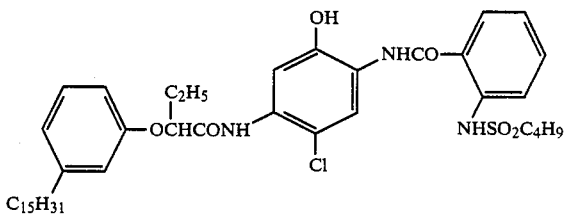

(C-4)

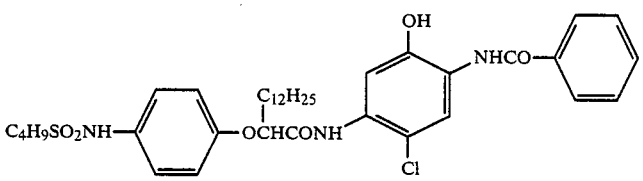

(C-5)

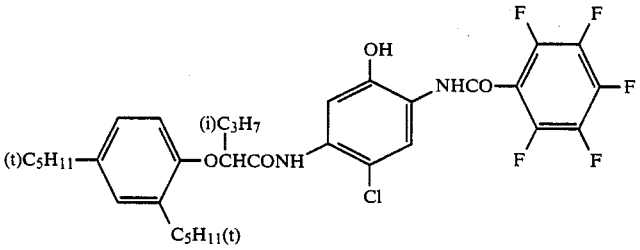

(C-6)

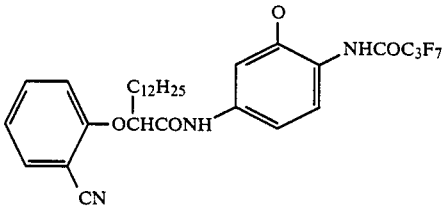

-continued
(C-7)
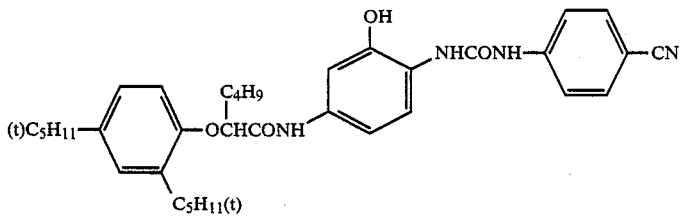
(C-8)
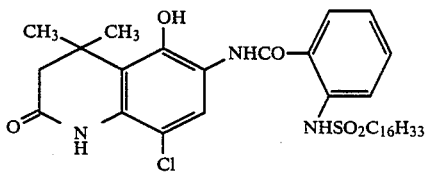
(C-9)
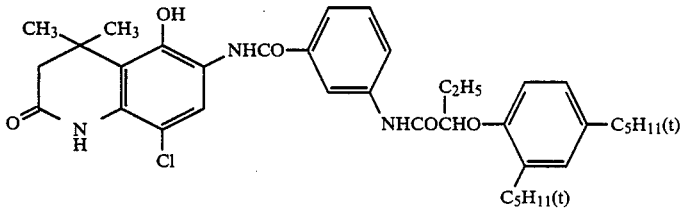
(C-10)
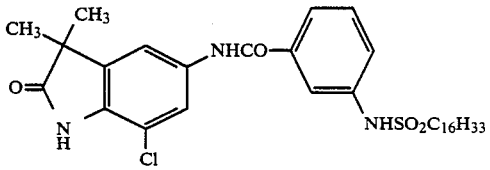
(C-11)
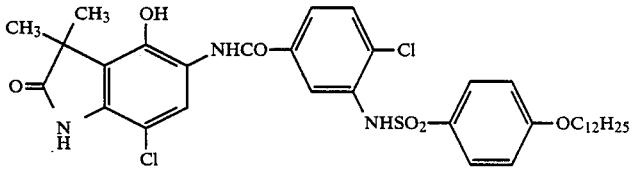
(C-12)
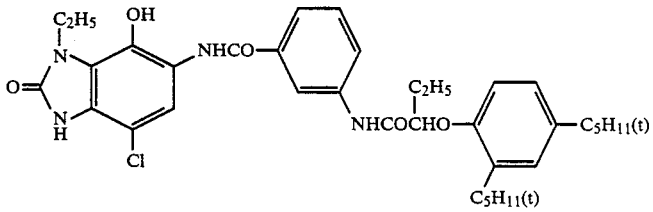
(C-13)
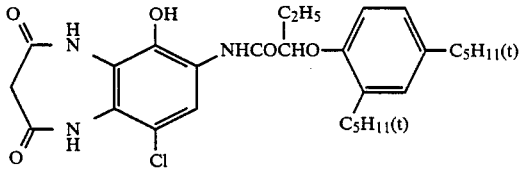

-continued (C-14)

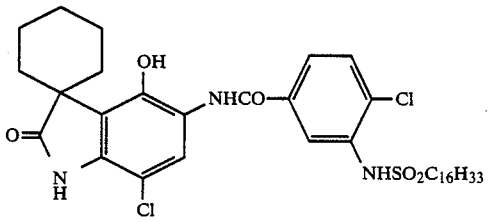

The cyan couplers of formula (II) can be used together with the cyan couplers of formula (III).

As yellow couplers which may be used in the present invention, acylacetamide derivatives such as benzoylacetanilide and pivaloylacetanilide are preferred.

Above all, yellow couplers as represented by the following formula (IV) or (V) are preferred for use in the present invention.

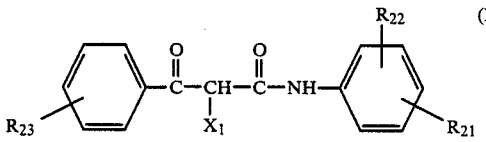

(IV)

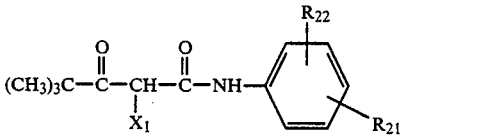

(V)

wherein $X_1$ represents a hydrogen atom or a coupling-releasing group; $R_{21}$ represents a nondiffusible group having a total of from 8 to 32 carbon atoms; $R_{22}$ represents a hydrogen atom, a halogen atom, a lower alkyl group, a lower alkoxy group or a nondiffusible group having a total carbon number of from 8 to 32, provided that there can be plural $R_{22}$'s and which can be the same or different; $R_{23}$ represents a hydrogen atom or a substituent, provided that when the benzene ring in the formula (IV) has two or more $R_{23}$'s, these may be the same or different.

Pivaloylacetanilide yellow couplers are described in detail in U.S. Pat. No. 4,622,287, from column 3, line 15 to column 8, line 39 and U.S. Pat. No. 4,623,616, from column 14, line 50 to column 19, line 41.

Benzoylacetanilide yellow couplers are described in detail in U.S. Pat. Nos. 3,408,194, 3,933,501, 4,046,575, 4,133,958 and 4,401,752.

Specific examples of pivaloylacetanilide couplers which may be used in the present invention include Compounds (Y-1) to (Y-39) disclosed in U.S. Pat. No. 4,622,287, columns 37 to 54; above all, Compounds (Y-1), (Y-4), (Y-6), (Y-7), (Y-15), (Y-21), (Y-22), (Y-23), (Y-26), (Y-35), (Y-36), (Y-37), (Y-38) and (Y-39) are especially preferred.

In addition, Compounds (Y-1) to (Y-33) described in U.S. Pat. No. 4,623,616, column 19 to 24 are also preferred for use in the present invention; above all, Compounds (Y-2), (Y-7), (Y-8), (Y-12), (Y-20), (Y-21), (Y-23) and (Y-29) are especially preferred.

As other couplers which may preferably be used in the present invention, there are further mentioned Compound (34) described in U.S. Pat. No. 3,408,194, column 6; Compounds (16) and (19) described in U.S. Pat. No. 3,933,501, column 8; Compound (9) described in U.S. Pat. No. 4,046,575, columns 7 to 8; Compound (1) described in U.S. Pat. No. 4,133,958, columns 5 to 6; Compound (1) described in U.S. Pat. No. 4,401,752, column 5, and the following Compounds (a) to (g).

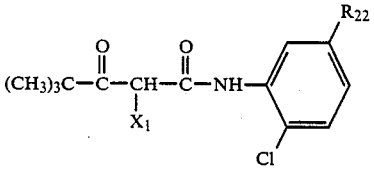

| Compound | $R_{22}$ | $X_1$ |
|---|---|---|
| a | $-COOCH(CH_3)COOC_{12}H_{25}$ | 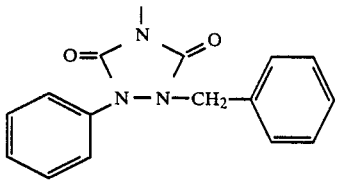 |
| b | $-COOCH(C_4H_9)COOC_{12}H_{25}$ | " |

-continued
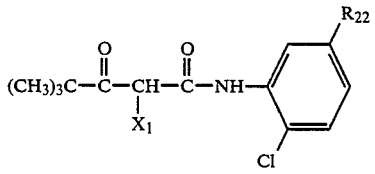
| Compound | $R_{22}$ | $X_1$ |
|---|---|---|
| c | 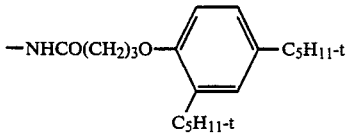 | 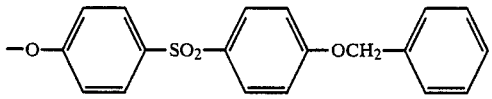 |
| d | 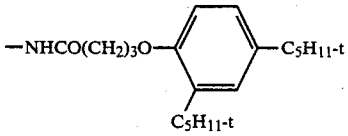 | 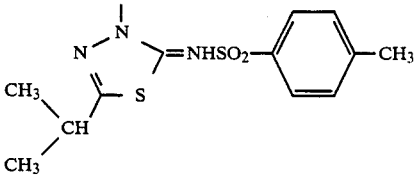 |
| e | 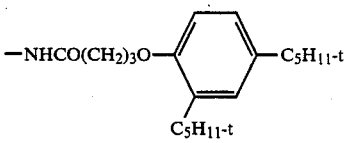 | 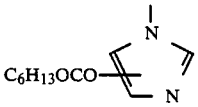 |
| f | $-NHSO_2C_{12}H_{25}$ | 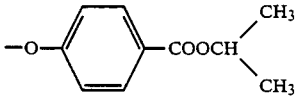 |
| g | $-NHSO_2C_{16}H_{33}$ | 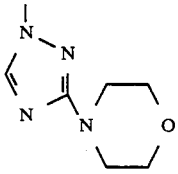 |
| h | 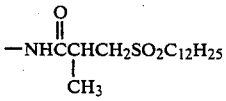 | 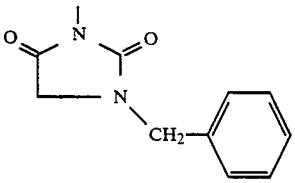 |
| i | 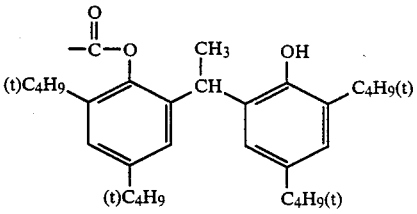 | 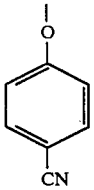 |

-continued

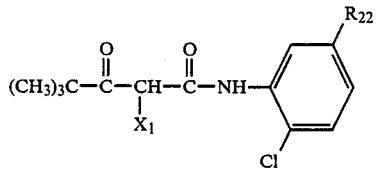

| Compound | $R_{22}$ | $X_1$ |
|---|---|---|
| j | 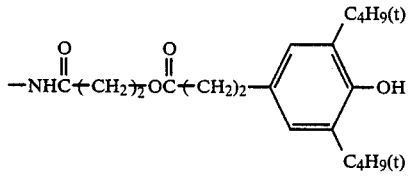 | 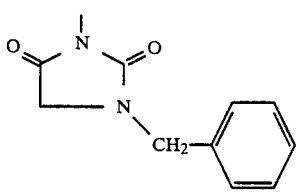 |

Among the above-mentioned couplers, those having a nitrogen atom as a releasing atom are especially preferred.

As magenta couplers which may be used in the present invention, there are oil-protective type indazolone or cyanoacetyl couplers, and preferably 5-pyrazolone couplers and pyrazoloazole couplers such as pyrazolotriazoles, as typical examples. 5-Pyrazolone couplers are preferably those substituted by an arylamino group or an acylamino group on the 3-position thereof in view of the hue of the dye to be formed therefrom as well as of the coloring speed of the coupler. Specific examples of the preferred couplers are described in U.S. Pat. Nos. 2,311,082, 2,343,703, 2,600,788, 2,908,573, 3,062,653, 3,152,896 and 3,936,015. As the releasing group for 2-equivalent 5-pyrazolone couplers, the nitrogen atom-releasing group described in U.S. Pat. No. 4,310,619 and the arylthio group described in U.S. Pat. No. 4,351,897 and JP-WO 88/04795 are preferred. The ballast group-containing 5-pyrazolone couplers described in European Patent 73,636 have a high coloring reactivity.

As pyrazoloazole couplers for use in the present invention, there may be mentioned, for example, the pyrazolobenzimidazoles described in U.S. Pat. No. 3,369,879, and preferably the pyrazolo[5,1-c][1,2,4]triazoles described in U.S. Pat. No. 3,725,067, the pyrazolotetrazoles described in RD No. 24220 (June, 1984) and the pyrazolopyrazoles described in RD No. 24230 (June, 1984). These couplers may be in the form of a polymer coupler.

The coupler compounds can be represented by the following general formulae (VI), (VII) and (VIII).

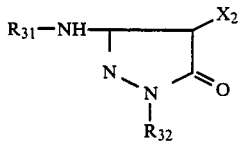

(VI)

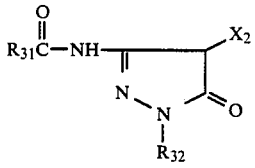

(VII)

-continued

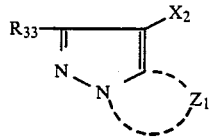

(VIII)

wherein $R_{31}$ represents a nondiffusible group having a total carbon number of from 8 to 32; $R_{32}$ represents a phenyl group or a substituted phenyl group; $R_{33}$ represents a hydrogen atom or a substituent; $Z_1$ represents a nonmetallic atomic group necessary for forming a 5-membered azole ring having from 2 to 4 nitrogen atoms, wherein the azole ring may optionally have substituent(s) (including condensed ring(s)); and $X_2$ represents a hydrogen atom or a releasing group.

Specific examples of the substituents for $R_{33}$ and the substituents for the azole ring are described, for example, in U.S. Pat. No. 4,540,654, from column 2, line 41 to column 8, line 27.

Among the pyrazoloazole couplers, the imidazo[1,2-b]pyrazoles described in U.S. Pat. No. 4,500,630 are preferred in view of the small yellow side-absorption of the colored dyes to be formed and of the high light fastness thereof, and the pyrazolo[1,5-b][1,2,4]triazoles described in U.S. Pat. No. 4,540,654 are especially preferred.

In addition, the pyrazolotriazole couplers having a branched alkyl group in the 2-, 3- or 6-position of the pyrazolotriazole ring described in JP-A-61-65245, the pyrazoloazole couplers containing a sulfonamido group in the molecule described in JP-A-61-65246, the pyrazoloazole couplers having an alkoxyphenylsulfonamido ballast group described in JP-A-61-147254, and the pyrazolotriazole couplers having an alkoxy group or an aryloxy group in the 6-position described in European Patent (Laid-Open) No. 226,849 are also preferably used in the present invention.

Specific examples of these couplers are illustrated below.

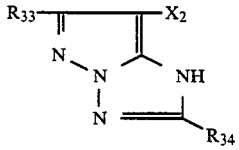
| Compound | $R_{33}$ | $R_{34}$ | $X_2$ |
|---|---|---|---|
| M-1 | $CH_3$— | 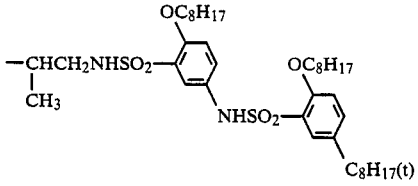 | Cl |
| M-2 | " | 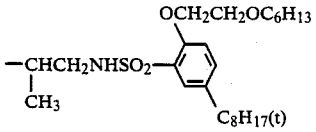 | " |
| M-3 | " | 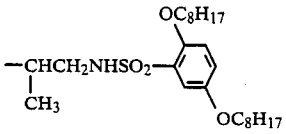 | 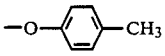 |
| M-4 | 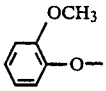 | 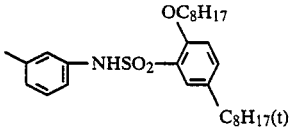 | 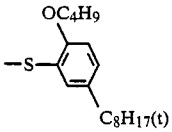 |
| M-5 | $CH_3$— | 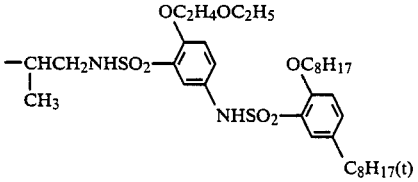 | Cl |
| M-6 | $CH_3$— | 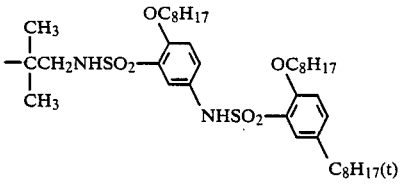 | Cl |
| M-7 | 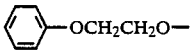 | 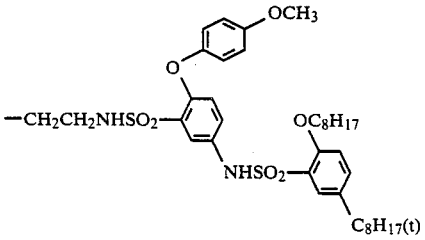 | 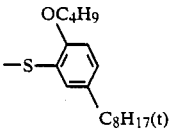 |
| M-8 | $CH_3CH_2O$— | " | " |
| M-9 | 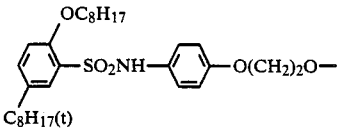 | 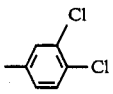 | 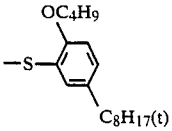 |

-continued
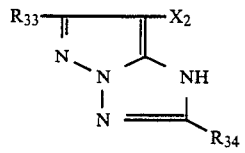
| Compound | $R_{33}$ | $R_{34}$ | $X_2$ |
|---|---|---|---|
| M-10 | 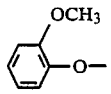 | 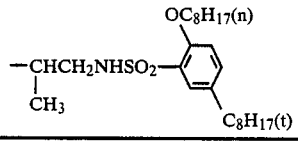 | Cl |
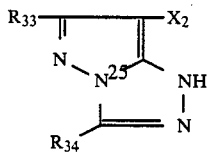
| Compound | $R_{33}$ | $R_{34}$ | $X_2$ |
|---|---|---|---|
| M-11 | $CH_3$— | 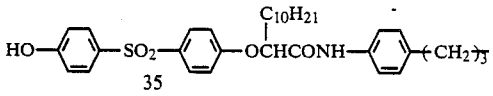 | Cl |
| M-12 | " | 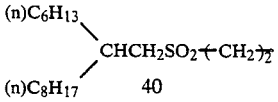 | " |
| M-13 | 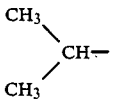 | 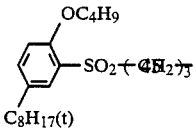 | " |
| M-14 | 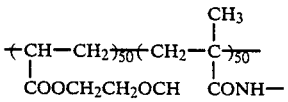 | 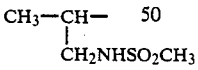 | Cl |
| M-15 | 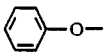 | 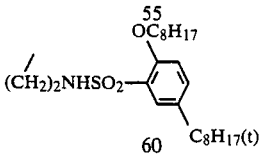 | Cl |
| M-16 | 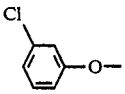 | 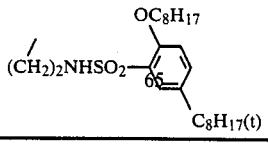 | 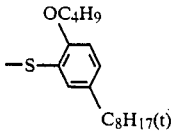 |

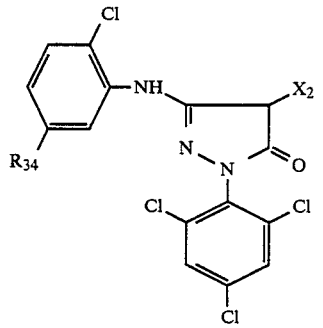
| Compound | $R_{34}$ | $X_2$ |
|---|---|---|
| M-17 | 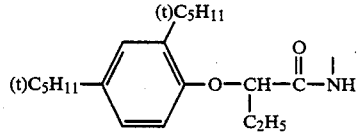 | H |
| M-18 | " | 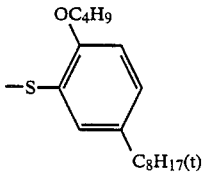 |
| M-19 | " | 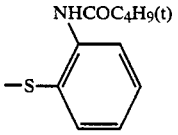 |
| M-20 | 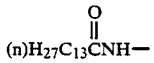 | H |
| M-21 | " | 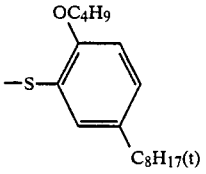 |
| M-22 | " | 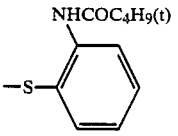 |
| M-23 | 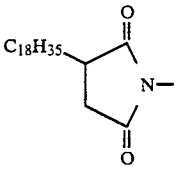 | H |
| M-24 | 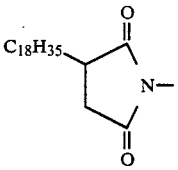 | 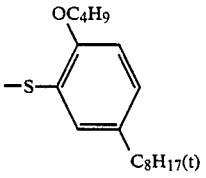 |

-continued

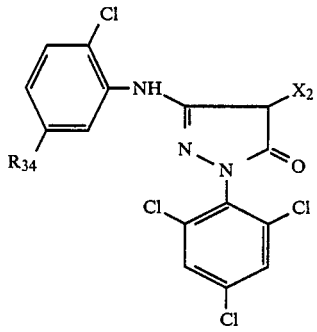

| Compound | $R_{34}$ | $X_2$ |
|---|---|---|
| M-25 | " | 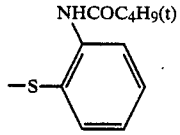 |

The compounds of formula (I) of the present invention can be used for emulsification and dispersion of an ultraviolet absorbent as a photographically useful reagent. For example, the compounds can be used for dispersing the aryl group-substituted benzotriazoles described in U.S. Pat. Nos. 3,553,794 and 4,236,013, JP-B-51-6540 and European Patent 57,160; the butadienes described in U.S. Pat. Nos. 4,450,229 and 4,195,999; the cinnamic acid esters described in U.S. Pat. Nos. 3,705,805 and 3,707,375; the benzophenones described in U.S. Pat. 3,215,530 and British Patent 1,321,355, and the ultraviolet absorbent residue-containing polymers described in U.S. Pat. Nos. 3,761,272 and 4,431,726. Further, these may also be used for dispersing the ultraviolet absorbing brightening agents described in U.S. Pat. Nos. 3,499,762 and 3,700,455. Typical examples of ultraviolet absorbents which may be used in the present invention are described in RD No. 24239 (June, 1984).

Specific examples of ultraviolet absorbents which may preferably be used in the present invention are illustrated below.

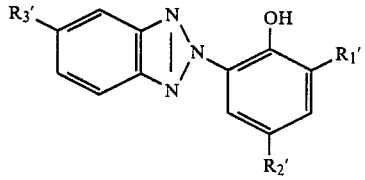

| | $R_1'$ | $R_2'$ | $R_3'$ |
|---|---|---|---|
| (UV-1) | $C_5H_{11}(t)$ | $C_5H_{11}(t)$ | H |
| (UV-2) | $C_5H_{11}(t)$ | $C_8H_{17}(t)$ | H |
| (UV-3) | H | $C_4H_9(t)$ | H |
| (UV-4) | $C_4H_9(t)$ | $CH_3$ | Cl |
| (UV-5) | $C_4H_9(t)$ | $C_4H_9(t)$ | H |
| (UV-6) | $C_4H_9(t)$ | $C_4H_9(t)$ | Cl |
| (UV-7) | $C_4H_9(sec)$ | $C_4H_9(t)$ | H |
| (UV-8) | $C_4H_9$ | $CH_2CH_2COOC_8H_{17}$ | Cl |
| (UV-9) | H | $CH_3$ | H |
| (UV-10) | 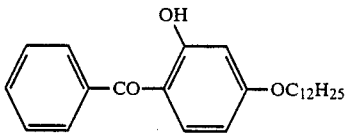 | | |
| (UV-11) | 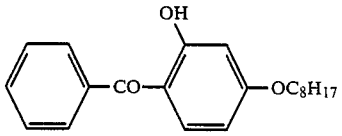 | | |

-continued
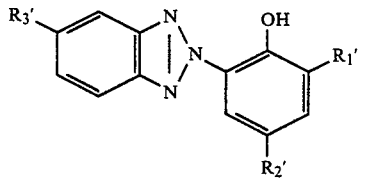
| | $R_1'$ | $R_2'$ | $R_3'$ |
|---|---|---|---|
| (UV-12) | 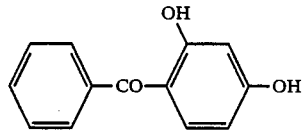 | | |
| (UV-13) | 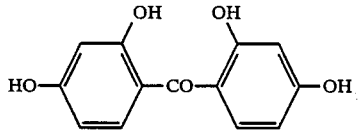 | | |
| (UV-14) | 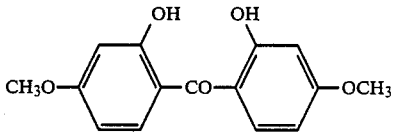 | | |
| (UV-15) | 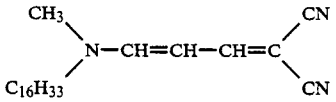 | | |
| (UV-16) | 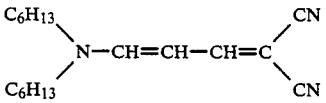 | | |
| (UV-17) | 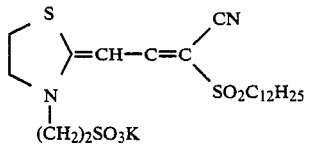 | | |
| (UV-18) | 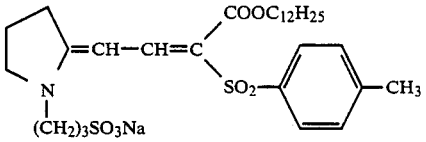 | | |
| (UV-19) | 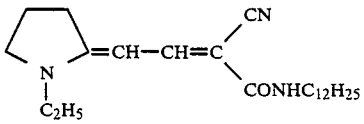 | | |
| (UV-20) | 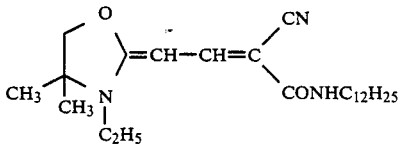 | | |
| (UV-21) | 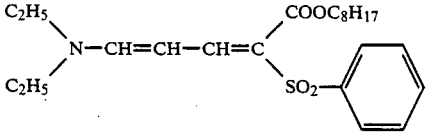 | | |

-continued
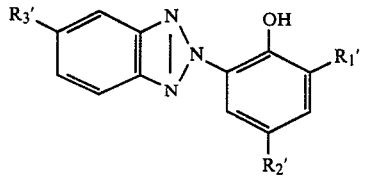
| $R_1'$ | $R_2'$ | $R_3'$ |
|---|---|---|
(UV-22)
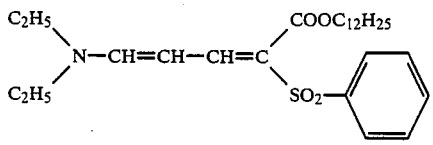
(UV-23)
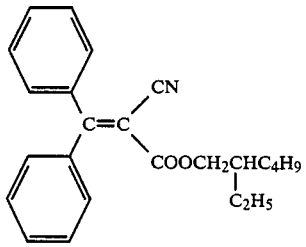
(UV-24)
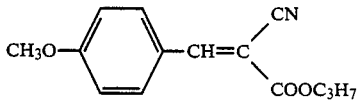
(UV-25)
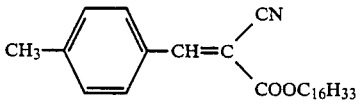
(UV-26)
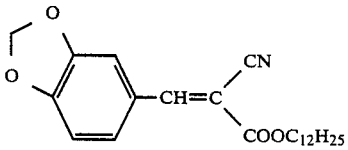
(UV-27)
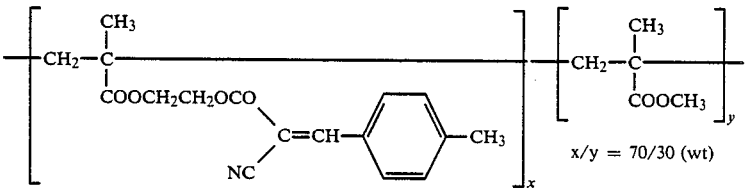
x/y = 70/30 (wt)
(UV-28)
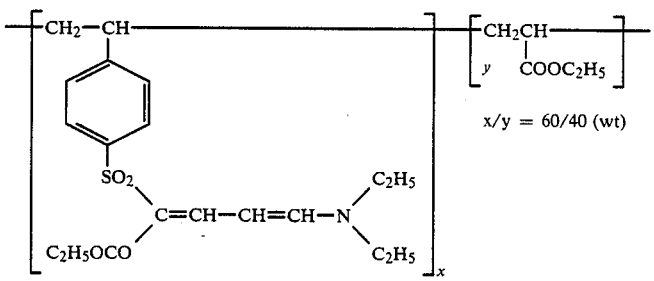
x/y = 60/40 (wt)

-continued

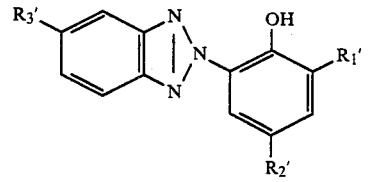

| $R_1'$ | $R_2'$ | $R_3'$ |
|---|---|---|

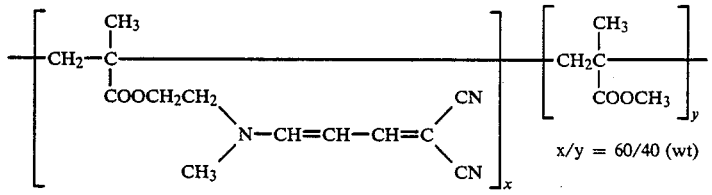

x/y = 60/40 (wt)

(UV-29)

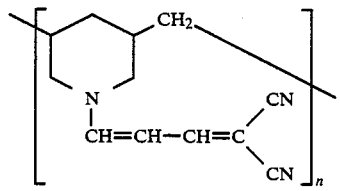

The present invention may also be applied to organic or metal complex type antifading agents or color mixing preventing agents to be used for improvement of the storage stability of color images formed, for prevention of staining in the white background part in the processed photographic materials and for prevention of interlayer color mixing in the processed photographic materials.

As typical examples of the agents, there may be mentioned hindered phenols such as hydroquinones, 6-hydroxychromans, 5-hydroxycoumarans, spirochromans, spiroindanes, p-alkoxyphenols and bisphenols, and gallic acid derivatives, methylenedioxybenzenes, aminophenols, hindered amines, as well as their ether or ester derivatives formed by silylation, acylation or alkylation of the phenolic hydroxyl group in the compounds, and additionally, metal complexes are also known.

Specific examples of hydroquinones are described in U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromans, 5-hydroxycoumarans and spirochromans in U.S. Pat. Nos. 3,432,300; 3,573,050, 3,574,627, 3,698,909 and 3,764,337 and JP-A-52-152225; spiroindanes in U.S. Pat. No. 4,360,589; p-alkoxyphenols in U.S. Pat. No. 2,735,765, British Patent 2,066,975(B), JP-A-59-10539 and JP-B-57-19764; hindered phenols in U.S. Pat. No. 3,700,455, JP-A-52-72225, U.S. Pat. No. 4,228,235 and JP-B-52-6623; gallic acid derivatives, methylenedioxybenzenes and aminophenols in U.S. Pat. Nos. 3,457,079 and 4,332,886 and JP-B-56-21144, respectively; hindered amines in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344; phenolic hydroxyl-etherified or esterified derivatives in U.S. Pat. Nos. 4,155,765, 4,174,220, 4,254,216 and 4,264,720, JP-A-54-145530, JP-A-55-6321, JP-A-58-105147 and JP-A-59-10539, JP-B-57-37856, U.S. Pat. No. 4,279,990 and JP-B-53-3263; and metal complexes in U.S. Pat. Nos. 4,050,938 and 4,241,155 and British Patent 2,027,731(A).

Examples of antifading agents and color mixing preventing agents are illustrated below.

(A-1)

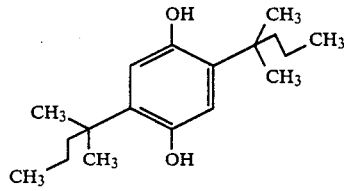

(A-2)

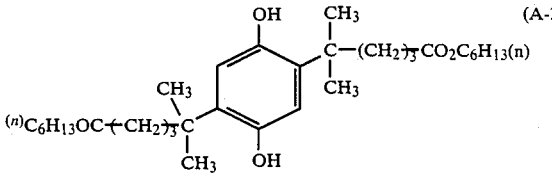

(A-3)

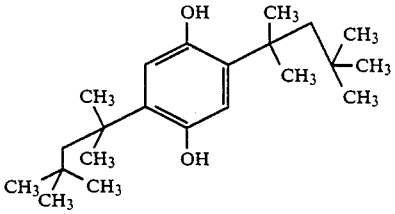

(A-4)

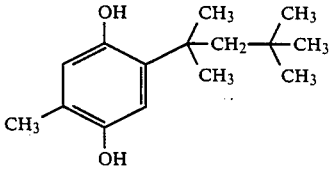

-continued
(A-5)
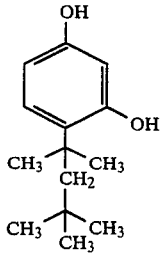
(A-6)
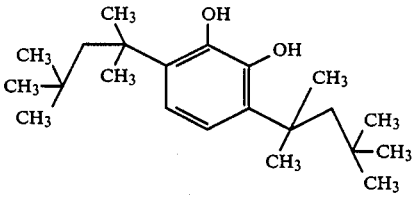
(A-7)
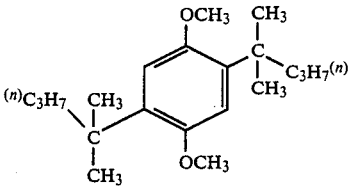
(A-8)
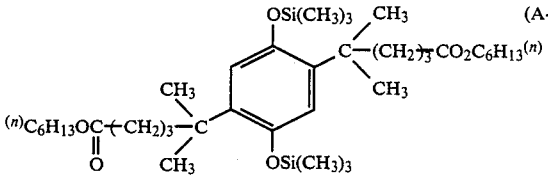
(A-9)
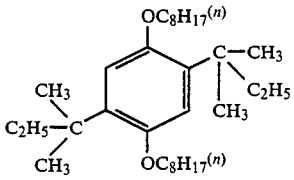
(A-10)
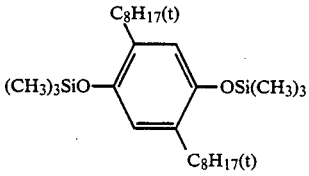
(A-11)
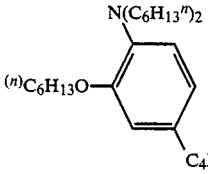
(A-12)
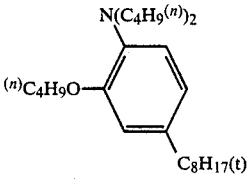
-continued
(A-13)
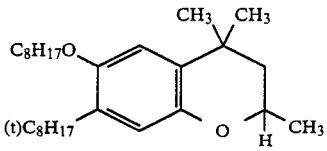
(A-14)
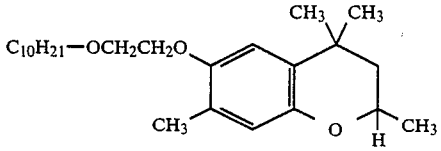
(A-15)
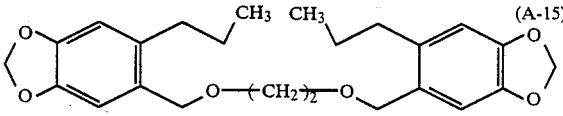
(A-16)
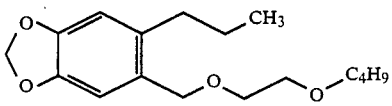
(A-17)
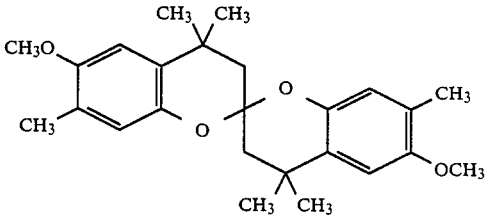
(A-18)
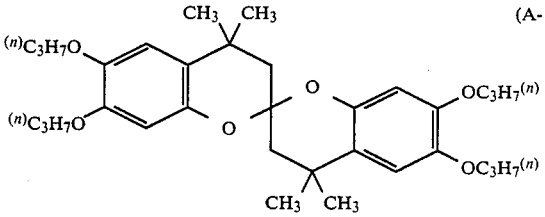
(A-19)
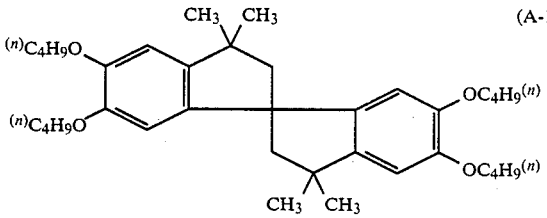
(A-20)
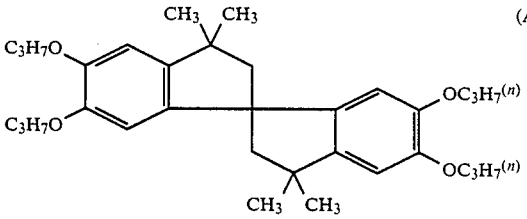
(A-21)
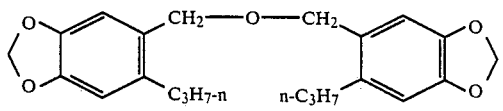

-continued
(A-22)
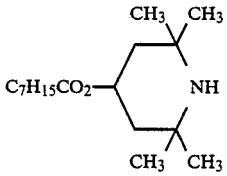
(A-23)
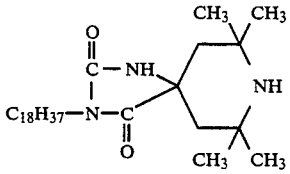
(A-24)
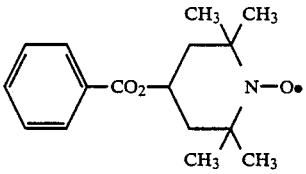
(A-25)
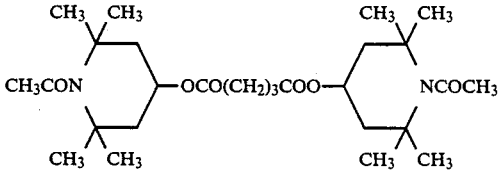
(A-26)
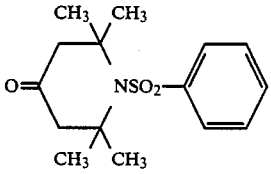
(A-27)
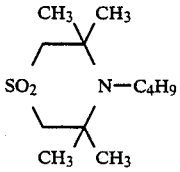
(A-28)
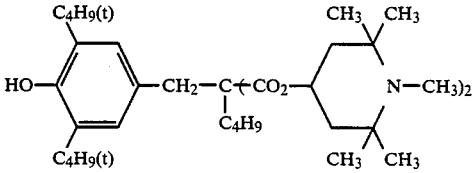
(A-29)
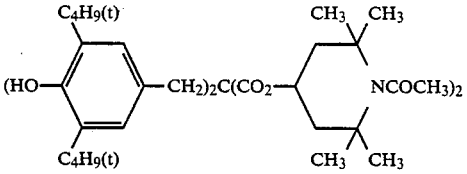
(A-30)
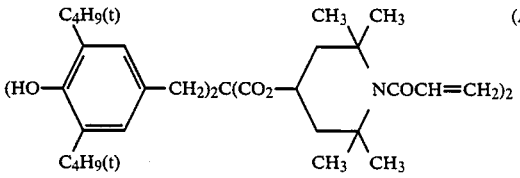
-continued
(A-31)
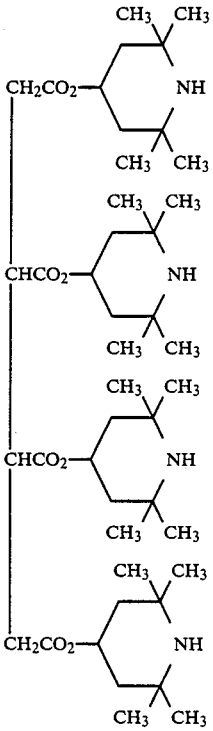
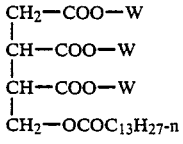
(A-32)
W represents
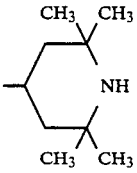
(A-33)
W represents
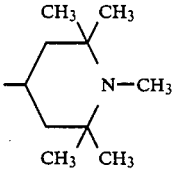
(A-34)
W represents
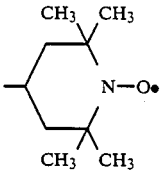
(A-35)
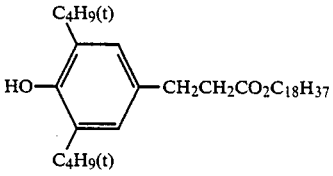

-continued
(A-36)
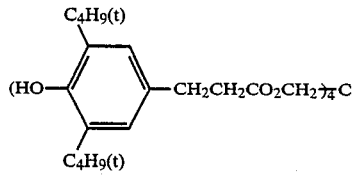
(A-37)
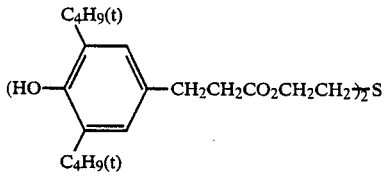
(A-38)
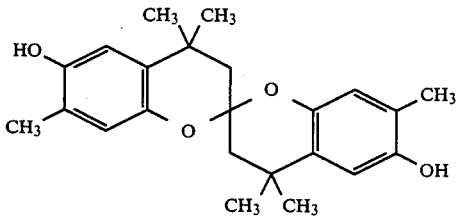
(A-39)
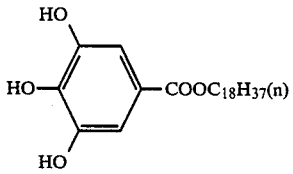
(A-40)
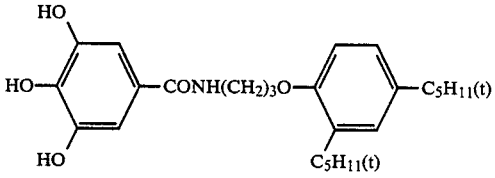
(A-41)
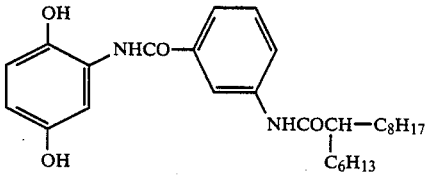
(A-42)
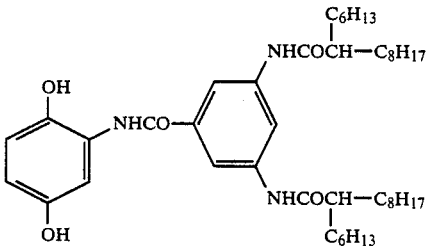
(A-43)
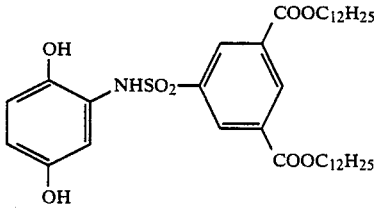
-continued
(A-44)
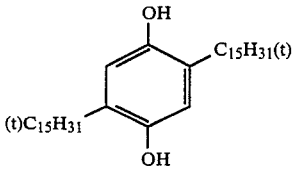
(A-45)
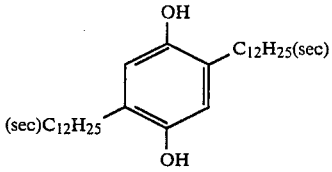
(A-46)
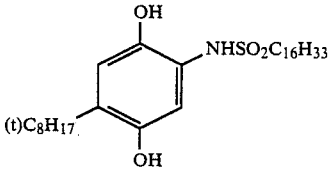
(A-47)
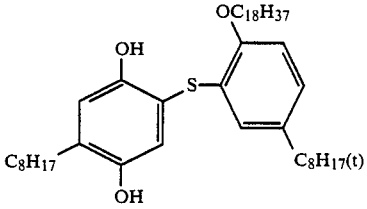
(A-48)
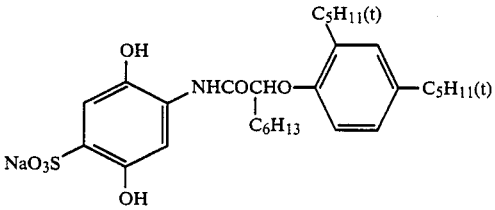
(A-49)
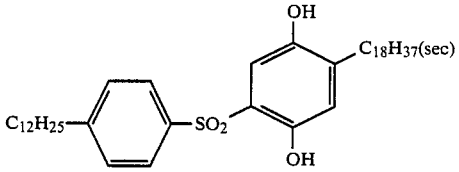
(A-50)
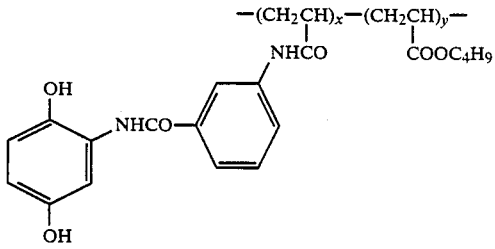
x/y = 40/60 (wt)
(A-51)
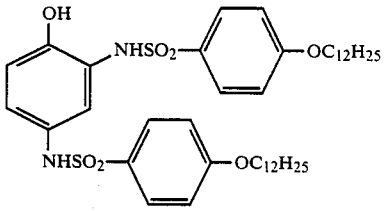

-continued (A-52)

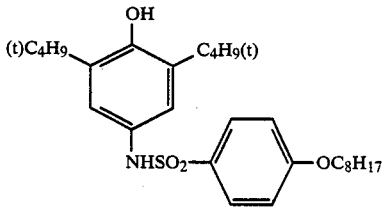

(A-53)

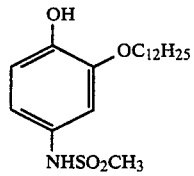

(A-54)

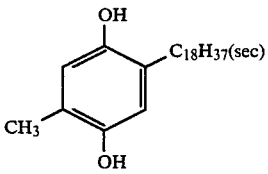

(A-55)

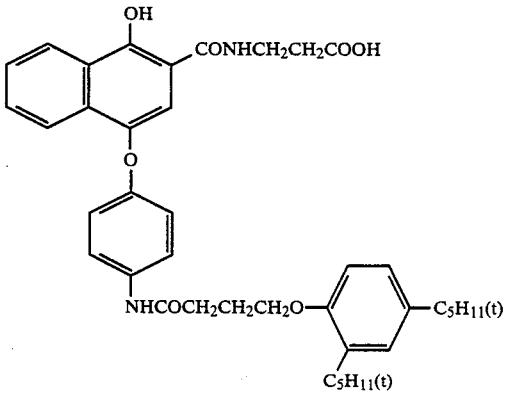

(A-56)

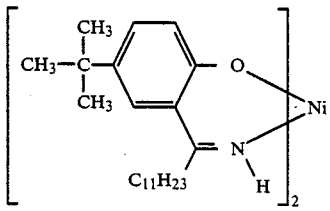

(A-57)

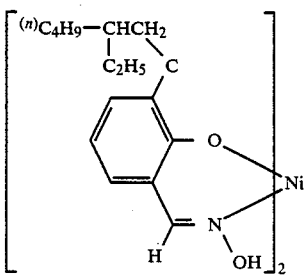

-continued (A-58)

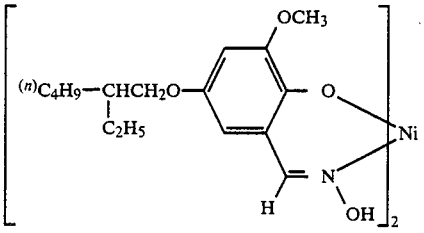

The high boiling point organic solvents of the present invention can be applied to various color photographic materials. As typical examples, there may be mentioned color negative films for general use or for movies, color reversal films for slides or televisions, color papers, color positive films, color reversal papers, color diffusion transfer type photographic materials and heat-developing type color photographic materials. Using the three color coupler mixing method described in RD No. 17123 (July, 1978) and also using the black-coloring couplers described in U.S. Pat. No. 4,126,461 and British Patent 2,102,136, the present invention may also be applied to black-and-white photographic materials, such as, for example, X-ray films. Moreover, the present invention can further be applied to photomechanical process films such as lith films or scanner films, X-ray films for direct or indirect medical use or for industrial use, picture-taking negative black-and-white films, black-and-white photographic papers, microfilms for COM use or for general use, silver salt diffusion transfer type photographic materials and print-out type photographic materials.

The method for processing the photographic materials of the present invention will be mentioned in detail hereinafter.

Color Developing Agents

The color developing agent to be used for development of the photographic materials of the present invention is an aqueous alkaline solution consisting essentially of an aromatic primary amine color developing agent. As the aromatic primary amine developing agent for this purpose, aminophenol compounds are useful but, in general, p-phenylenediamine compounds are advantageous. As examples, of these compounds, there are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and their sulfates, hydrochlorides, phosphates, p-toluenesulfonates, tetraphenylborates and p-(t-octyl)benzenesulfonates.

N-Hydroxyalkyl-substituted-p-phenylenediamine Derivatives

In view of the object of the present invention which is directed to attainment of simple and rapid processing of the photographic materials of the present invention, developing agents which have an especially high developing rate and which are relatively stable with respect to the variation of the developing activity even under the condition of small replenishment are preferred for use in processing the photographic materials of the present invention. Developing agents represented by the following general formula (IX), which include 3-methyl-4-amino-N-ethyl-N-β-hydroxyethylaniline as a typical example, are preferred. In formula (IX), $R_{41}$ represents a hydrogen atom, an alkyl group (preferably having from 1 to 6 carbon atoms) or $R_{42}$; $R_{42}$ represents $-(R'_4O)_{m1}-(R'_5O)_{n1}-R'_6$; $R'_4$ and $R'_5$ may be the same or different and each represents an alkylene group (preferably having from 1 to 4 carbon atoms); $m_1$ and $n_1$ each independently represents 0 or an integer of from 1 to 4, but both of them must not be 0 at the same time; $R'_6$ represents a hydrogen atom, an aryl group (preferably from 6 to 8 carbon atoms) or an alkyl group (preferably having from 1 to 6 carbon atoms); and $R_{43}$ represents a hydrogen atom, a halogen atom, an alkyl group, a hydroxyl group, an alkoxy group, an alkylsulfonamido group, an acylamido group or an amino group.

The carbon number in the group $R_{43}$ is preferably from 1 to 4.

Specific examples of compounds represented by formula (IX) are shown in the following table.

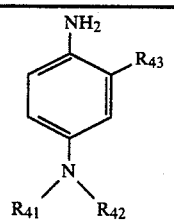

(IX)

| Compound No. | $R_{41}$ | $R_{42}$ | $R_{43}$ |
|---|---|---|---|
| 1 | $-C_2H_5$ | $-C_2H_4OH$ | $-CH_3$ |
| 2 | $-C_2H_5$ | $-C_3H_6OH$ | $-CH_3$ |
| 3 | $-C_2H_5$ | $-C_2H_4OH$ | $-H$ |
| 4 | $-CH_3$ | $-C_2H_4OH$ | $-CH_3$ |
| 5 | $-C_3H_7$ | $-C_2H_4OH$ | $-CH_3$ |
| 6 | $-CH_3$ | $-C_2H_4OCH$ | $-CH_3$ |
| 7 | $-C_2H_5$ | $-C_2H_4OCH$ | $-CH_3$ |
| 8 | $-CH_3$ | $-CH(CH_3)CH_2OCH_3$ | $-CH_2CH_2OCH_3$ |
| 9 | $-C_2H_5$ | $-C_2H_4OC_2H_5$ | $-CH_3$ |
| 10 | -(n)-$C_4H_9$ | $-C_2H_4OH$ | $-CH_3$ |

The color developing agent is used generally in an amount of from 1 g to 30 g, preferably from 2 g to 20 g, more preferably from 3 g to 10 g, per liter of color developer.

Color developing agents, such as the compounds of formula (IX), are in many cases used singly, but if desired, two or more of the same kinds of developing agents or two or more of different kinds of developing agents may be used in combination. For instance, there may be mentioned a combination of 3-methyl-4-amino-N-ethyl-N-β-hydroxyethylaniline and 3-ethyl-4-amino-N-β-methanesulfonamidoethylaniline, and a combination of 3-methyl-4-amino-N-ethyl-N-β-methoxyethylaniline and 3-methyl-4-amino-N-ethyl-N-β-methanesulfonamidoethylaniline.

Additives to Color Developer

The color developer for use in the method of the present invention may contain a pH buffer such as carbonates, borates or phosphates of alkali metals; a development inhibitor or antifoggant such as chlorides, bromides, iodides, benzimidazoles, benzothiazoles or mercapto compounds; a preservative such as hydroxylamine, diethylhydroxylamine, triethanolamine, the compounds described in West German Patent Application (OLS) 2,622,950, the compounds described in Japanese Patent Application No. 61-265149, a preservative such as sulfites or bisulfites; an organic solvent such as diethylene glycol; a development accelerator such as benzyl alcohol, polyethylene glycol, quaternary ammonium salts, amines, thiocyanates or 3,6-thiaoctane-1,8-diol; a competing coupler; an auxiliary developing agent such as 1-phenyl-3-pyrazolidone; a tackifier; and a chelating agent such as aminopolycarboxylic acids (e.g., ethylenediaminetetraacetic acid, nitrilotriacetic acid, cyclohexanediaminetetraacetic acid, iminodiacetic acid, hydroxyethyliminodiacetic acid, N-hydroxymethylethylenediaminetriacetic acid, diethylenetriaminepentaacetic acid, triethylenetetraminehexaacetic acid and the compounds described in JP-A-58-195845), 1-hydroxyethylidene-1,1'-diphosphonic acid, the organic phosphonic acids described in RD No. 18170 (May, 1979), aminophosphonic acids (e.g., aminotris(methylenephosphonic acid)ethylenediamine-N,N,N',N'-tetramethylenephosphonic acid) or the phosphonocarboxylic acids described in JP-A-52-102726, JP-A-53-42730, JP-A-54-121127, JP-A-55-4024, JP-A-55-4025, JP-A-55-126241, JP-A-55-65955, and JP-A-55-65956, and RD No. 18710 (May, 1979).

The pH value of the color developer is generally within the range of from 8 to 13, preferably from 9 to 12, and more preferably from 9.5 to 11.5. The processing temperature may be within the range of from 25° to 50° C., but this is preferably from 30° to 50° C. for rapid processing, and more preferably from 35° to 45° C.

In processing the photographic materials of the present invention, the color developer preferably contains a water-soluble chloride in an amount of from $1\times10^{-3}$ mol/liter to $2\times10^{-1}$ mol/liter, more preferably from $5\times10^{-3}$ mol/liter to $5\times10^{-2}$ mol/liter. As the water-soluble chloride for the purpose, potassium chloride or sodium chloride is preferably used.

When the photographic materials of the present invention are continuously processed, the color developer may be used continuously with adding a replenisher thereto, and the amount of the replenisher is preferably from 1 to 10 ml per 100 $cm^2$ of the material being processed. Further, a water-soluble bromide may also be preferably added to the color developer in an amount of from $3\times10^{-3}$ mol/liter to $3\times10^{-2}$ mol/liter, for the purpose of prevention of fogging. As the water-soluble bromide for the purpose, potassium bromide or sodium bromide is preferably used.

In the processing method of the present invention, a color developer which does not substantially contain iodide ion is preferably used. The color developer "which does not substantially contain iodide ion" means that the developer has an iodide content of 1.0 mg/liter or less.

It is preferred that the color developer for use in the present invention does not contain any sulfite, provided that the aerial oxidation of the developer is prevented and the preservative state may be well maintained. Precisely, the color developer contains a sulfite in an amount of 4 g (as sulfurous anhydride) or less, preferably 2 g or less, more preferably 1 g or less, per liter of the developer, whereby the coloring density of color images to be formed may be improved.

The development time with the color developer is from 10 seconds to 3 minutes and 30 seconds, preferably from 10 seconds to 2 minutes, and more preferably from 20 seconds to 1 minute and 30 seconds.

Delivering Step

The photographic materials of the present invention are desilvered, after having been color-developed. The desilvering step may be conducted by any method selected from a method of using two baths of a bleaching solution and a fixing solution, the method of using two baths of a bleaching solution and a bleach-fixing solution described in JP-A-61-75352, the method of using two baths of a fixing solution and a bleach-fixing solution described in JP-A-61-51143 and a method of using one bath of a bleach-fixing solution. In view of the object of simple and rapid processing in the present invention, the photographic materials of the present invention are preferably processed in a single or plural bleach-fixing baths.

As the bleaching agent to be used in the bleaching solution or bleach-fixing solution, there may be mentioned ferric salts, persulfates, bichromates, bromates, red prussiate of potash (potassium ferricyanide) and aminopolycarboxylic acid ferric complex salts, and in particular, aminopolycarboxylic acid ferric complex salts are most preferred for processing the photographic materials of the present invention.

Examples of preferred aminopolycarboxylic acid ferric complex salts are mentioned below.

(1) Ethylenediaminetetraacetic acid ferric complex salt
(2) Diethylenetriaminepentaacetic acid ferric complex salt
(3) Cyclohexanediaminetetraacetic acid ferric complex salt
(4) Iminodiacetic acid ferric complex salt
(5) Methyliminodiacetic acid ferric complex salt
(6) 1,3-diaminopropanetetraacetic acid ferric complex salt s
(7) Glycoletherdiaminetetraacetic acid ferric complex salt The above-mentioned aminopolycarboxylic acid ferric complex salts are generally used in the form of sodium salts, potassium salts or ammonium salts, and ammonium salts are most preferred.

The concentration of the aminopolycarboxylic acid ferric complex salt in the bleaching solution or bleach-fixing solution is from 0.05 to 1 mol/liter, preferably from 0.1 to 1 mol/liter and more preferably from 0.1 to 0.5 mol/liter.

A bleaching accelerator may be added to the bleaching solution or bleach-fixing solution, if desired. Examples of useful bleaching accelerators include the mercapto group or disulfido group-containing compounds described in U.S. Pat. No. 3,893,858, West German Patents 1,290,812 and 2,059,988, JP-A-53-32736, JP-A-53-57831, JP-A-53-37418, JP-A-53-65732, JP-A-53-72623, JP-A-53-95630, JP-A-53-95631, JP-A-53-104232, JP-A-53-124424, JP-A-53-141623 and JP-A-53-28426 and RD No. 17129 (July, 1978); the thiazolidine derivatives described in JP-A-50-140129; the thiourea derivatives described in JP-B-45-8506, JP-A-52-20832 and JP-A-53-32735 and U.S. Pat. No. 3,706,561; the iodides described in West German Patent 1,127,715 and JP-A-58-16235; the polyethylene oxides described in West German Patents 966,410 and 2,748,430; the polyamine compounds described in JP-B-45-8836; and the compounds described in JP-A-49-42434, JP-A-49-59644, JP-A-53-94927, JP-A-53-35727, JP-A-55-26505 and JP-A-58-163940 and iodide and bromide ions. Above all, mercapto group or disulfide group-containing compounds are especially preferred as having a high accelerating activity, and in particular, the compounds described in U.S. Pat. No. 3,893,858, West German Patent 1,290,812 and JP-A-53-95630 are more preferred.

In addition, the bleaching solution or bleach-fixing solution may further contain a rehalogenating agent, such as bromides (e.g., potassium bromide, sodium bromide, ammonium bromide), chlorides (e.g., potassium chloride, sodium chloride, ammonium chloride) or iodides (e.g., ammonium iodide). If desired, the solution may also contain one or more inorganic acids and organic acids having a pH buffer capacity and their alkali metal or ammonium salts, such as boric acid, borax, sodium metaborate, acetic acid, sodium acetate, sodium carbonate, potassium carbonate, phosphorus acid, phosphoric acid, sodium phosphate, citric acid, sodium citrate or tartaric acid, or an anticorrosive agent such as ammonium nitrate or guanidine.

The fixing agent to be used in the bleach-fixing solution or fixing solution for use in the method of the present invention may be a conventional known fixing agent, or that is, a water-soluble silver halide-solubilizing agent, for example, thiosulfates (e.g., sodium thiosulfate, ammonium thiosulfate); thiocyanates (e.g., sodium thiocyanate, ammonium thiocyanate); or thioether compounds or thiourea compounds (e.g., ethylenebisthioglycolic acid, 3,6-dithia-1,8-octanediol). The agents may be used singly or in combination of two or more of them. In the method of the present invention, thiosulfates, especially ammonium thiosulfate, are particularly preferred.

The amount of the fixing agent is preferably from 0.3 to 2 mols, more preferably from 0.8 to 1.5 mols, per liter of the bleach-fixing solution or fixing solution.

The pH range of the bleach-fixing solution or fixing solution is preferably from 3 to 10, more preferably from 3.0 to 6.0. When the pH is low, the desilvering potency of the solution is high. By the use of the compound of the present invention, the conversion of the cyan dye in the photographic material into a leuco dye may be prevented. The pH value of the bleaching solution to be used in the method of the present invention is from 3 to 7, preferably from 3.5 to 6.5.

In order to adjust the pH value of the processing solution, chloric acid, sulfuric acid, nitric acid, acetic acid, bicarbonates, ammonia, potassium hydroxide, sodium hydroxide, sodium carbonate or potassium carbonate may be added to the solution, if desired.

The bleach-fixing solution or fixing solution contains, as a preservative, a sulfite ion-releasing compound such as sulfites (e.g., sodium sulfite, potassium sulfite, ammonium sulfite), bisulfites (e.g., ammonium bisulfite, sodium bisulfite, potassium bisulfite), metabisulfites (e.g., potassium metabisulfite, sodium metabisulfite, ammonium metabisulfite), etc. The compound is preferably incorporated into the solution in an amount of from about 0.02 to about 0.5 mol/liter, more preferably from 0.04 to 0.40 mol/liter, as sulfite ion.

As a preservative, sulfites are generally used, but ascorbic acid or carbonyl-bisulfite adducts or carbonyl compounds may also be used.

The temperature in the desilvering step is preferably higher, provided that the higher temperature does not cause a problem of too much softening of the gelatin film of the photographic material being processed and deterioration of the processing solutions being used. The desilvering temperature may be selected from the temperature range of from 30° to 50° C. The desilvering time is, although somewhat varying in accordance with the desilvering method employed, generally 4 minutes or less, preferably from 30 seconds to 3 minutes.

Rinsing in Water and Stabilization

The photographic materials of the present invention are, after desilvered by fixation or bleach-fixation, generally rinsed in water and/or stabilized.

The amount of the rinsing water to be used in rinsing-in-water step may be defined in a broad range, in accordance with the specific characteristics of the photographic materials (because of couplers and other components used) and the use thereof, the temperature of the rinsing water, the number of the rinsing tanks (number of rinsing stages), the normal current or countercurrent replenishment system and other various conditions. The relation between the number of the rinsing tanks and the amount of the rinsing water to be used in a multistage countercurrent system may be obtained by the method described in *Journal of the Society of Motion Picture and Television Engineers,* Vol. 64, pages 248 to 253 (May, 1955). In general, the number of the stages in a multistage countercurrent rinsing system is preferably from 2 to 6, more preferably from 2 to 4.

In accordance with the multistage countercurrent system, the amount of the rinsing water to be used may noticeably be reduced, and, for example, it may be from 0.5 liters to 1 liter per $m^2$ of the photographic material being processed. However, because of increase of the resident time of the rinsing water in the rinsing tank, there is a problem of propagation of bacteria in the rinsing tank and adhesion of the floating material (formed from the propagated bacteria) to the photographic material being processed. In order to overcome this problem in the method of processing the photographic materials of the present invention, th method of reducing the calcium and magnesium concentration in the rinsing solution described in JP-A-62-288838 may be used very effectively. In addition, the isothiazolone compounds and thiobenzazoles described in JP-A-57-8542; chlorine series bactericides such as the chlorinated sodium isocyanurates described in JP-A-61-120145; the benzotriazoles described in JP-A-61-267761; and other bactericides and fungicides described in H. Horiguchi, *Chemistry of Bactericidal and Fungicidal Agents,* and *Bactericidal and Fungicidal Techniques to Microorganisms,* edited by Association of Sanitary Technique, Japan, and *Encyclopedia of Bactericidal and Fungicidal Agents,* edited by Nippon Bactericide and Fungicide Association can also be used for the purpose.

In addition, a surfactant, as a water-cutting agent, as well as a chelating agent such as EDTA, as a water softener, can also be added to the rinsing water.

The pH value of the rinsing water to be used in the method of processing the photographic materials of the present invention is generally from 4 to 9, preferably from 5 to 8. The temperature of the rinsing water and the rinsing time can also be set variously in accordance with the characteristics of the photographic materials being processed and the use thereof, and, in general, the temperature is from 15° to 45° C. and the time is from 20 seconds to 10 minutes, and preferably, the temperature is from 25° to 40° C. and the time is from 30 seconds to 5 minutes.

Following the rinsing step, the material can be processed with a stabilizing solution, or alternatively, the material can be processed directly with a stabilizing solution without taking the rinsing step. To the stabilizing solution can be added a compound having an image stabilizing function. For example, aldehyde compounds such as formaldehyde, buffers for adjusting the film pH value to that suitable for image stabilization, as well as ammonium compounds can be added to the stabilizing solution. In addition, the above-mentioned various kinds of bactericides and fungicides can also be added to the stabilizing solution to prevent the propagation of bacteria in the solution or to impart a fungicidal capacity to the photographic materials as processed.

Further, a surfactant, a brightening agent and a hardening agent can also be added to the stabilizing solution. In the method of processing the photographic materials of the present invention, when the stabilization step is directly carried out without the water rinsing step, any and every known method, for example, the methods described in JP-A-57-8543, JP-A-58-14834, JP-A-59-184343, JP-A-60-220345, JP-A-60-238832, JP-A-60-239784, JP-A-60-239749, JP-A-61-4053 and JP-A-61-118749 can be utilized.

In addition, a chelating agent such as 1-hydroxyethylidene-1,1-diphosphonic acid or ethylenediaminetetramethylenephosphonic acid, as well as a bismuth compound can also be preferably used.

The solution used in the rinsing-in-water step and/or stabilization step can be reused again in the previous step. As an example, there may be mentioned a process in which the overflow of the rinsing water, which has been reduced in the multistage countercurrent system, is returned back to the previous bleach-fixing bath and a fresh concentrated solution is replenished into the bleach-fixing bath so as to decrease the amount of the resulting waste drainage.

Development

When a large amount of the photographic materials of the present invention are processed by the method of the present invention, continuous processing is desired. In the case of disc-shaped films, the exposed films may be put in a defined bath where color development, bleach-fixation, rinsing and stabilization may be conducted in order. In the case of photographic film rolls or color paper rolls, these are preferred to be introduced and conveyed through the processing baths in order. As the film conveying system, there are a guide film system, a roller conveyance system and a rack induction system.

When a long photographic material is continuously developed, a replenisher is added to the processing bath so as to replenish the components as consumed by processing, and the unnecessary and harmful components which would be dissolved out from the photographic materials being processed are removed out from the processing system. In addition, it is also desired to correct the composition variation to be caused by aerial oxidation of the developer being used. In the process, a means to lower the amount of the replenisher has been tried to be put to practical use, so as to lower the amount of the waste drainage from the process. For example, the solution as overflown in the rinsing step or stabilization step is reused in the previous bath, as mentioned above, and the solution as overflown from the developer bath may also be reused in the bleach-fixation bath.

The time of processing the photographic material of the present invention in accordance with the method of the present invention may be about 1 to 5 minutes, from the beginning of development to the finish of drying, and preferably, the time may be from 1 to 3.5 minutes, more preferably within 120 seconds or less.

The following examples are intended to illustrate the present invention but not to limit it in any way.

EXAMPLE 1

A multilayer silver halide photographic material sample (1-A) was prepared by forming the layers, each having the composition mentioned below, on a paper support both surfaces of which had been coated with polyethylene. The coating compositions used were prepared as mentioned below.

Preparation of Coating Composition for First Layer 27.2 cc of ethyl acetate and 7.7 cc (8.0 g) of high boiling point solvent (Solv-1) were added to 10.2 g of yellow coupler (ExY-1), 9.1 g of yellow coupler (ExY-2) and 4.4 g of color image stabilizer (Cpd-1) and dissolved, and the resulting solution was dispersed by emulsification in 185 cc of a 10 wt% aqueous gelatin solution containing 8 cc of a 10 wt% sodium dodecylbenzenesulfonate solution. The resultant emulsified dispersion and emulsions (EM1) and (EM2) were blended together and dissolved to prepare a coating composition for the first layer, whereupon the gelatin concentration was adjusted as mentioned below. Other coating compositions for the second to seventh layers were also prepared in the same manner as the coating composition for the first layer. As a gelatin hardening agent for each layer, 1-hydroxy-3,5-dichloro-s-triazine sodium salt was used.

As a tackifier was used (Cpd-2).

The chemical constitution of each layer was as mentioned below. The amount of each component coated is represented by the unit of g/m$^2$. The silver halide emulsion coated is represented by the unit of g/m$^2$ as silver.

Support

Polyethylene-coated paper (this contained a white pigment ($TiO_2$) and a bluish dye in the polyethylene on the side of the first layer)

| | |
|---|---|
| First Layer: Blue-Sensitive Layer | |
| Monodispersed silver chlorobromide emulsion (EM1) (spectrally sensitized with sensitizing dye (ExS-1)) | 0.13 |
| Monodispersed silver chlorobromide emulsion (EM2) (spectrally sensitized with sensitizing dye (ExS-1)) | 0.13 |
| Gelatin | 1.86 |
| Yellow coupler (ExY-1) | 0.44 |
| Yellow coupler (ExY-2) | 0.39 |
| Color image stabilizer (Cpd-1) | 0.19 |
| Solvent (Solv-1) | 0.35 |

-continued

| | |
|---|---|
| Second Layer: Color Mixing Preventing Layer | |
| Gelatin | 0.99 |
| Color mixing preventing agent (Cpd-3) | 0.08 |
| Third Layer: Green-Sensitive Layer | |
| Monodispersed silver chlorobromide emulsion (EM3) (spectrally sensitized with sensitizing dyes (ExS-2, ExS-3)) | 0.05 |
| Monodispersed silver chlorobromide emulsion (EM4) (spectrally sensitized with sensitizing dyes (ExS-2, ExS-3)) | 0.11 |
| Gelatin | 1.80 |
| Magenta coupler (ExM-1) | 0.39 |
| Color image stabilizer (Cpd-4) | 0.20 |
| Solvent (Solv-2) | 0.12 |
| Solvent (Solv-3) | 0.25 |
| Fourth Layer: Ultraviolet Absorbing Layer | |
| Gelatin | 1.60 |
| Ultraviolet absorbent (Cpd-7/Cpd-8/Cpd-9 = 3/2/6, by weight) | 0.70 |
| Color mixing preventing agent (Cpd-10) | 0.05 |
| Solvent (Solv-4) | 0.27 |
| Fifth Layer: Red-Sensitive Layer | |
| Monodispersed silver chlorobromide emulsion (EM6) (spectrally sensitized with sensitizing dyes (ExS-4, ExS-5)) | 0.07 |
| Monodispersed silver chlorobromide emulsion (spectrally sensitized with sensitizing dyes (ExS-4, ExS-5) | 0.16 |
| Gelatin | 0.92 |
| Cyan coupler (ExC-1) | 0.32 |
| Color image stabilizer (Cpd-8/Cpd-9/Cpd-12 = 3/4/2, by weight) | 0.17 |
| Dispersion polymer (Cpd-11 | 0.28 |
| Solvent (Solv-2) | 0.20 |
| Sixth Layer: Ultraviolet Absorbing Layer | |
| Gelatin | 0.54 |
| Ultraviolet absorbent (Cpd-7/Cpd-9/Cpd-12 = 1/5/3, by weight) | 0.21 |
| Solvent (Solv-2) | 0.08 |
| Seventh Layer: Protective Layer | |
| Gelatin | 1.33 |
| Acryl-modified copolymer of polyvinyl alcohol (modification degree: 17%) | 0.17 |
| Liquid paraffin | 0.03 |

| Emulsion | Shape | Grain Size (μm) | Br Content (mol %) | Fluctuation Coefficient |
|---|---|---|---|---|
| EM1 | Cubic | 1.0 | 80 | 0.08 |
| EM2 | Cubic | 0.75 | 80 | 0.07 |
| EM3 | Cubic | 0.5 | 83 | 0.09 |
| EM4 | Cubic | 0.4 | 83 | 0.10 |
| EM5 | Cubic | 0.5 | 73 | 0.09 |
| EM6 | Cubic | 0.4 | 73 | 0.10 |

The compounds used have the following structural formulae.

ExY-1

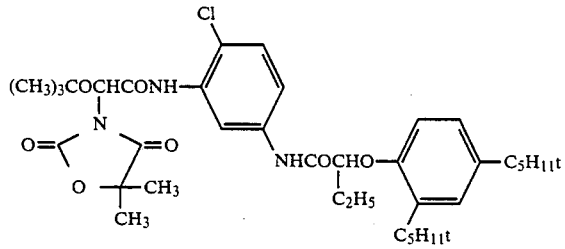

-continued
ExY-2
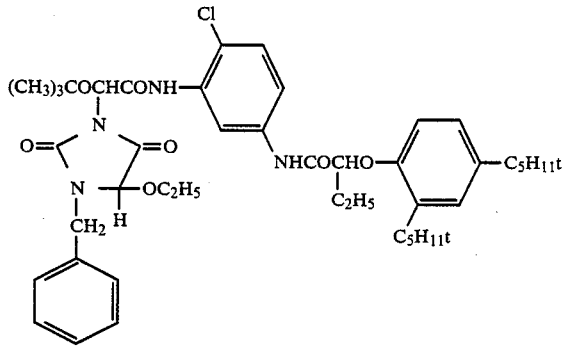
ExM-1
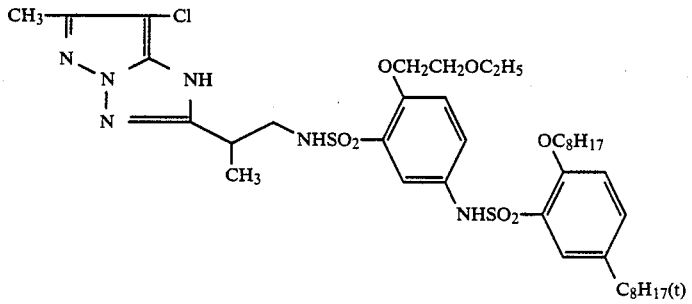
ExC-1
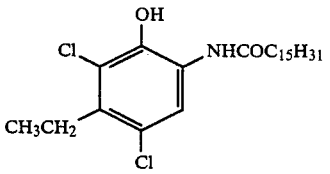
ExS-1
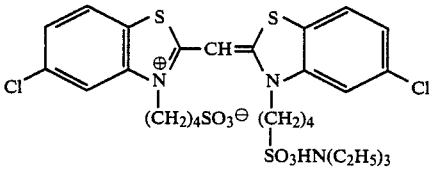
ExS-2
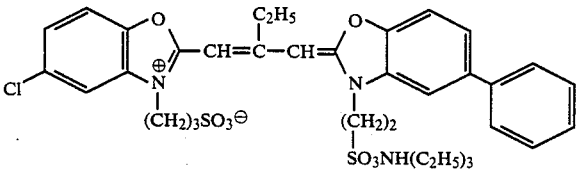
ExS-3
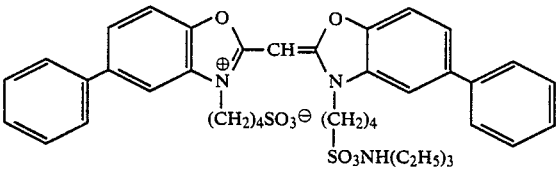
ExS-4
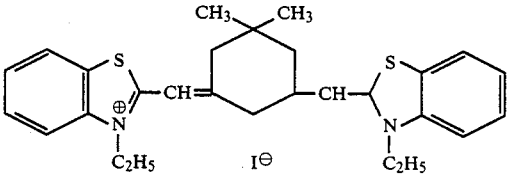

-continued
ExS-5
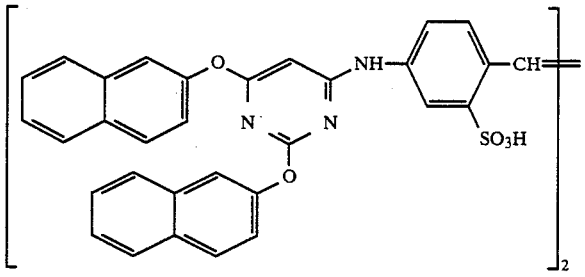
Cpd-1
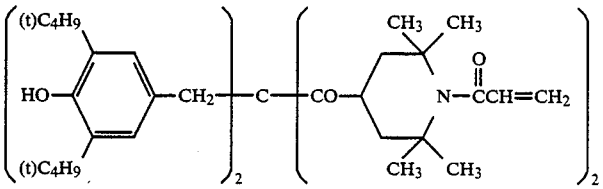
Cpd-2
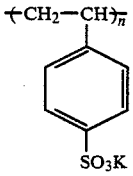
Cpd-3
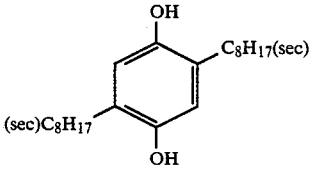
Cpd-4
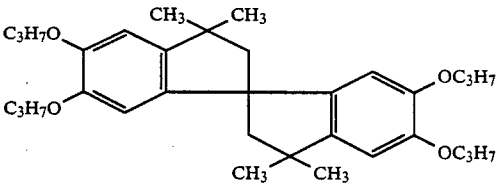
Cpd-7
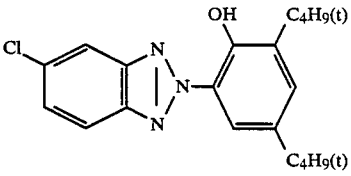
Cpd-8
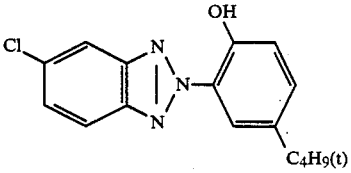
Cpd-9
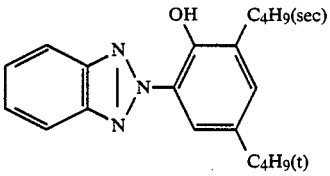

-continued

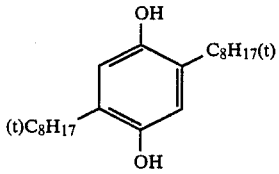

Cpd-10

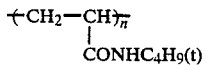

(n = 100~1000)
molecular weight: 100,000

Cpd-11

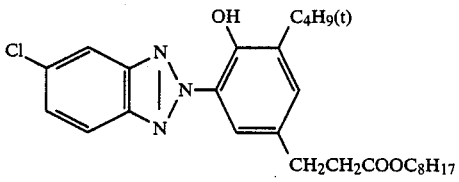

Cpd-12

Dibutyl Phthalate — Solv-1
Tricresyl Phosphate — Solv-2
Trioctyl Phosphate — Solv-3
Trinonyl Phosphate — Solv-4

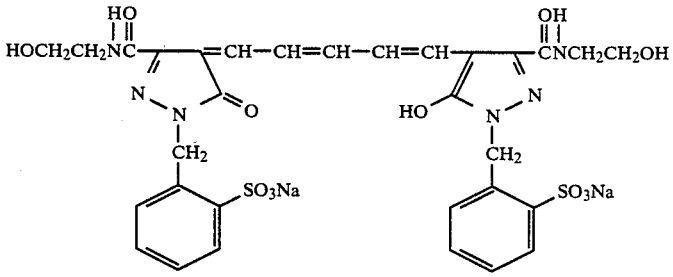

Cpd-13

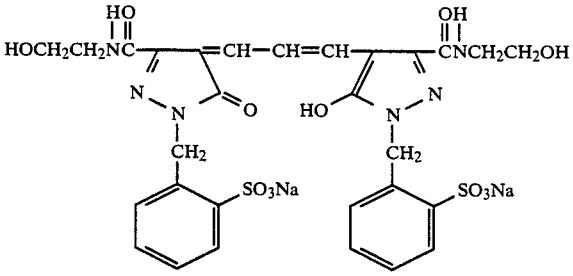

Cpd-14

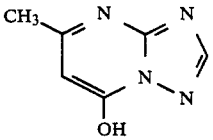

Cpd-15

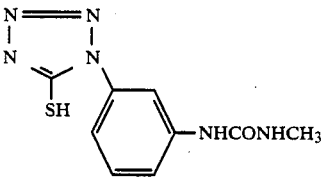

Cpd-16

Other photographic material samples (1-B) to (1-R) were prepared in the same manner as the sample (1-A), except that the yellow couplers in the first layer of the sample (1-A) were replaced by the coupler(s) as indicated in Table 1 below and that the compound of the present invention (see Table 1 below) was added in the same weight as the coupler(s). The thus-prepared samples were processed in accordance with the procedure mentioned below.

| Processing Step | Temperature (°C.) | Time |
|---|---|---|
| Color Development | 38 | 1 min 40 sec |
| Bleach-Fixation | 30–34 | 1 min 00 sec |
| Rinsing (1) | 30–34 | 20 sec |

-continued

| Processing Step | Temperature (°C.) | Time |
|---|---|---|
| Rinsing (2) | 30–34 | 20 sec |
| Rinsing (3) | 30–34 | 20 sec |
| Drying | 70–80 | 50 sec |

(The rinsing step was carried out by three tank counter-current system from the rinsing bath (3) to the rinsing bath (1).)

The processing solutions used were as follows.

| | |
|---|---|
| Color Developer: | |
| Water | 800 ml |
| Diethylenetriaminepentaacetic Acid | 1.0 g |
| 1-Hydroxyethylidene-1,1-diphosphonic Acid (60 wt % aqueous solution) | 2.0 g |
| Nitrilotriacetic Acid | 2.0 g |
| Benzyl Alcohol | 16 ml |
| Diethylene Glycol | 10 ml |
| Sodium Sulfite | 2.0 g |
| Potassium Bromide | 0.5 g |
| Potassium Carbonate | 30 g |
| N-Ethyl-N-(methanesulfonamidoethyl)-3-methyl-4-aminoaniline Sulfate | 5.5 g |
| Hydroxylamine Sulfate | 3.0 g |
| Brightening Agent (UVITEX-CK, by Ciba Geigy) | 1.5 g |
| Water to make | 1,000 ml |
| pH (25° C.) | 10.25 |
| Bleach-Fixing Solution: | |
| Water | 400 ml |
| Ammonium Thiosulfate (70 wt % aqueous solution) | 200 ml |
| Sodium Sulfite | 20 g |
| Ethylenediaminetetraacetic Acid Iron(III) Ammonium Complex | 60 g |
| Ethylenediaminetetraacetic Acid Disodium Salt | 10 g |
| Water to make | 1,000 ml |
| pH (25° C.) | 6.50 |
| Rinsing Solution: | |
| Ion-exchanged water (calcium and magnesium: each 3 ppm or less) | |

Immediately after processing, the reflection density in the yellow image part was measured. Then, the samples were subjected to light-fading est. As the criterion of the antifading property, the density of the part which had a density of 2.0 before the fading test was measured after the test, and the proportion of the latter (after test) to the former (before test) was represented by a percentage value.

The fading test was carried out with a xenon fade meter (95,000 lux) under the condition of irradiation of 250 hours. The results obtained are shown in Table 1 below.

TABLE 1

| Sample | Coupler | Additive | Percentage of Fading (%) | Note |
|---|---|---|---|---|
| 1-A | ExY-1/ExY-2 | — | 60 | Comparison |
| 1-B | " | R-1 | 64 | " |
| 1-C | " | R-2 | 63 | " |
| 1-D | " | R-3 | 61 | " |
| 1-E | " | R-4 | 61 | " |
| 1-F | " | I-7 | 78 | Invention |
| 1-G | " | I-8 | 77 | " |
| 1-H | " | I-9 | 80 | " |
| 1-I | " | I-10 | 81 | " |
| 1-J | " | I-13 | 78 | " |
| 1-K | " | I-16 | 76 | " |
| 1-L | " | I-33 | 74 | " |
| 1-M | " | I-37 | 73 | " |
| 1-N | " | I-8 | 74 | " |
| 1-O | " | I-9 | 84 | " |

TABLE 1-continued

| Sample | Coupler | Additive | Percentage of Fading (%) | Note |
|---|---|---|---|---|
| 1-P | " | I-10 | 70 | " |
| 1-Q | ExY-1 | I-13 | 71 | " |
| 1-R | ExY-2 | I-8 | 69 | " |
| 1-S | ExY-3 | I-9 | 72 | " |

The compounds used in the above were as follows.

(R-1)

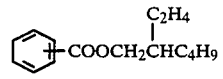

(Compound described in U.S. Pat. No. 4,080,209)

(R-2)

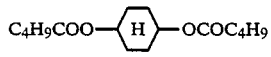

(Compound described in U.S. Pat. No. 374, 814)

(R-3)

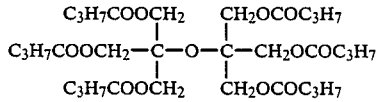

(Compound described in U.S. Pat. No. 4,004,928)

(R-4)

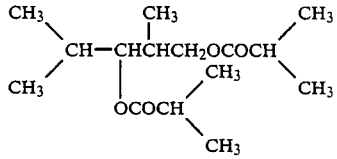

(Compound described in JP-A-51-27921)

(ExY-3)

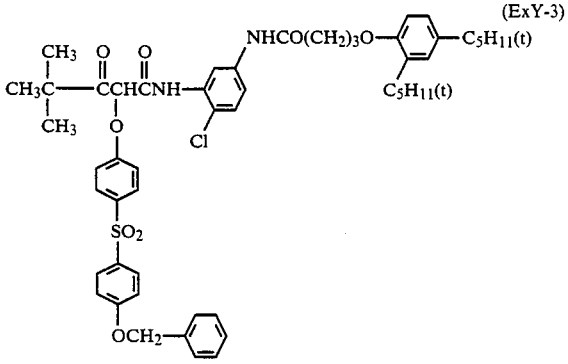

As is obvious from the results in Table 1, the light fading in the yellow image part was unexpectedly and remarkably suppressed by the addition of the compound of the present invention.

It was also found that the effect was even more unexpected and remarkable in the N-releasing type yellow couplers than in the O-releasing type yellow couplers.

On the other hand, the same process was repeated except that benzyl alcohol was removed from the color developer. As a result, the antifading effect was more unexpected and remarkable in the case using no benzyl alcohol than in the previous case using benzyl alcohol.

EXAMPLE 2

Photographic material samples (2-B) to (2-X) were prepared in the same manner as the sample (1-A) in Example 1, except that the cyan coupler in the fifth layer was replaced by the coupler as indicated in Table 2 below and that the compound of the present invention was added in the same weight as the coupler, in addition to the (Solv-2). The thus-prepared samples were processed in the same manner as in Example 1, except that the pH value of the bleach-fixing solution was changed to 6.0.

After processing, the maximum density (Dmax) of the cyan color image part was measured by way of the reflection density. Afterwards, the samples were dipped in reagents (CN-16) and (N-2) (manufactured by Fuji Photo Film Co., Ltd.), at 30° C. for 4 minutes whereby the cyan dye (leuco form) was converted back to the colorless dye. Then, the density was again measured, and the coloring potency of the cyan dye was obtained therefrom.

The coloring potency was calculated on the basis of the following formula:

$$\text{Coloring Potency} = \frac{\text{Cyan Density before Reprocessing}}{\text{Cyan Density after Reprocessing}} \times 100$$

TABLE 2

| Sample | Cyan Coupler | Additive | Coloring Efficiency (%) | Note |
|---|---|---|---|---|
| 1-A | ExC-1 (same as II-2 | — | 60 | Comparison |
| 2-B | II-7 | — | 65 | " |
| 2-C | II-23 | — | 61 | " |
| 2-D | II-5 | — | 70 | " |
| 2-E | II-2 | R-1 | 78 | " |
| 2-F | " | R-2 | 79 | " |
| 2-G | " | I-7 | 89 | Invention |
| 2-H | " | I-8 | 91 | " |
| 2-I | " | I-9 | 90 | " |
| 2-J | " | I-10 | 91 | " |
| 2-K | " | I-13 | 90 | " |
| 2-L | " | I-16 | 89 | " |
| 2-M | " | I-33 | 88 | " |
| 2-N | " | I-37 | 88 | " |
| 2-O | II-5 | I-7 | 88 | " |
| 2-P | " | I-10 | 90 | " |
| 2-Q | II-23 | I-7 | 90 | " |
| 2-R | " | I-13 | 89 | " |
| 2-S | " | I-16 | 90 | " |
| 2-T | " | I-37 | 88 | " |
| 2-U | II-7 | I-8 | 87 | " |
| 2-V | " | I-9 | 89 | " |
| 2-W | " | I-16 | 90 | " |
| 2-X | " | I-37 | 91 | " |
| 2-Y | " | R-3 | 70 | Comparison |

The compounds used in the above are as follows.

R-1

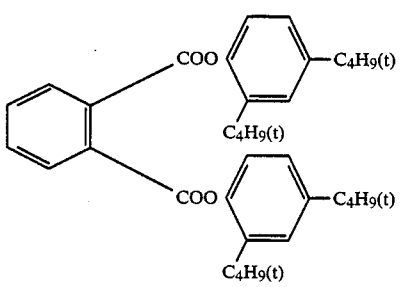

(Compound described in JP-A-62-134642)

R-2

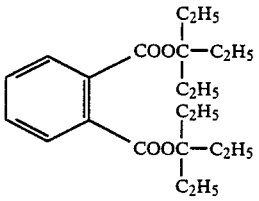

-continued (Compound described in European Patent 228,064)

R-3

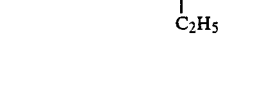

(Compound described in U.S. Pat. No. 3,936,303)

As is obvious from the results in Table 2, conversion of the cyan dye into a leuco form is unexpectedly and noticeably suppressed by the addition of the compound of the present invention.

EXAMPLE 3

A multilayer silver halide photographic material sample (3-A) was prepared by forming the layers each having the composition mentioned below on a paper support both surfaces of which had been coated with polyethylene. The coating compositions used were prepared as mentioned below.

Preparation of Coating Composition for First Layer 27.2 cc of ethyl acetate and 7.7 cc (8.0 g) of high boiling point solvent (Solv-1) were added to 19.1 g of yellow coupler (ExY-1) and 4.4 g of color image stabilizer (Cpd-1) and dissolved, and the resulting solution was dispersed by emulsification in 185 cc of a 10 wt% aqueous gelatin solution containing 8 cc of a 10 wt% sodium dodecylbenzenesulfonate solution. The thus-emulsified dispersion and emulsions (EM7) and (EM8) were blended together and dissolved to prepare a coating composition for the first layer, whereupon the gelatin concentration was adjusted as mentioned below. Other coating compositions for the second to seventh layers were also prepared in the same manner as the coating composition for the first layer. As a gelatin hardening agent for each layer, 1-hydroxy-3,5-dichloro-s-triazine sodium salt was used.

As a tackifier was used (Cpd-2).

The constitution of each layer was as mentioned below. The amount of each component coated is represented by the unit of g/m². The silver halide emulsion coated is represented by the unit of g/m² as silver.

Support

Polyethylene-coated paper (This contained a white pigment ($TiO_2$) and a bluish dye in the polyethylene on the side of the first layer.)

| | |
|---|---|
| First Layer: Blue-Sensitive Layer | |
| Monodispersed silver chlorobromide emulsion (EM7) (spectrally sensitized with sensitizing dye (ExS-1)) | 0.15 |
| Monodispersed silver chlorobromide emulsion (EM8) (spectrally sensitized with sensitizing dye (ExS-1)) | 0.15 |
| Gelatin | 1.86 |
| Yellow coupler (ExY-1) | 0.82 |
| Color image stabilizer (Cpd-12) | 0.19 |
| Solvent (Solv-1) | 0.35 |
| Second Layer: Color Mixing Preventing Layer | |
| Gelatin | 0.99 |
| Color mixing preventing agent (Cpd-3) | 0.08 |
| Third Layer: Green-Sensitive Layer | |
| Monodispersed silver chlorobromide emulsion (EM9) (spectrally sensitized with sensitizing dyes (ExS-2, ExS-3)) | 0.12 |
| Monodispersed silver chlorobromide emulsion (EM10) (spectrally sensitized with sensitizing dyes (ExS-2, ExS-3)) | 0.24 |

-continued

| | |
|---|---|
| Gelatin | 1.24 |
| Magenta coupler (ExM-1) | 0.39 |
| Color image stabilizer (Cpd-4) | 0.25 |
| Color image stabilizer (Cpd-5) | 0.12 |
| Solvent (Solv-2) | 0.25 |
| Fourth Layer: Ultraviolet Absorbing Layer | |
| Gelatin | 1.60 |
| Ultraviolet absorbent (Cpd-6/Cpd-7/Cpd-8 = 3/2/6, by weight) | 0.70 |
| Color mixing preventing agent (Cpd-9) | 0.05 |
| Solvent (Solv-3) | 0.42 |
| Fifth Layer: Red-Sensitive Layer | |
| Monodispersed silver chlorobromide emulsion (EM11) (spectrally sensitized with sensitizing dyes (ExS-4, ExS-5)) | 0.07 |
| Monodispersed silver chlorobromide emulsion (EM12) (spectrally sensitized with sensitizing dyes (ExS-4, ExS-5)) | 0.16 |
| Gelatin | 0.92 |
| Cyan coupler (ExC-1) | 0.15 |
| Cyan coupler (ExC-2) | 0.18 |
| Color image stabilizer (Cpd-7/Cpd-8/Cpd-10 = 3/4/2, by weight) | 0.17 |
| Dispersion polymer (Cpd-11) | 0.14 |
| Solvent (Solv-1) | 0.20 |
| Sixth Layer: Ultraviolet Absorbing Layer | |
| Gelatin | 0.54 |
| Ultraviolet absorbent (Cpd-6/Cpd-8/Cpd-10 = 1/5/3, by weight) | 0.21 |
| Solvent (Solv-4) | 0.08 |
| Seventh Layer: Protective Layer | |
| Gelatin | 1.33 |

-continued

| | |
|---|---|
| Acryl-modified copolymer of polyvinyl alcohol (modification degree: 17%) | 0.17 |
| Liquid paraffin | 0.03 |

As an anti-irradiation dye, (Cpd-12) and (Cpd-13) were used. In addition, each layer contained Alkanol XC (by Du Pont Co.), sodium alkylbenzenesulfonate, succinic acid ester and Megafac F-120 (by Dai-Nippon Ink Co.) as an emulsifying and dispersing agent and a coating aid. As a stabilizer for the silver halide were used (Cpd-14) and (Cpd-15).

The details of the emulsions used were as follows:

| Emulsion | Shape | Grain Size (m) | Br Content (mol %) | Fluctuation Coefficient |
|---|---|---|---|---|
| EM7 | Cubic | 1.1 | 1.0 | 0.10 |
| EM8 | Cubic | 0.8 | 1.0 | 0.10 |
| EM9 | Cubic | 0.45 | 1.5 | 0.09 |
| EM10 | Cubic | 0.34 | 1.5 | 0.09 |
| EM11 | Cubic | 0.45 | 1.5 | 0.09 |
| EM12 | Cubic | 0.34 | 1.6 | 0.10 |

$$\left(\text{Fluctuation Coefficient} = \frac{\text{Standard Deviation}}{\text{Mean Grain Size}}\right)$$

The compounds used in the above have the following structural formulae.

ExY-1

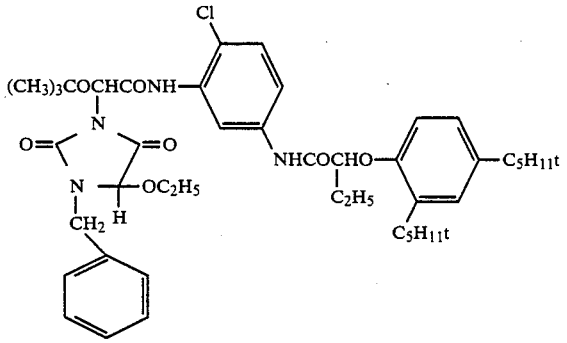

ExM-1

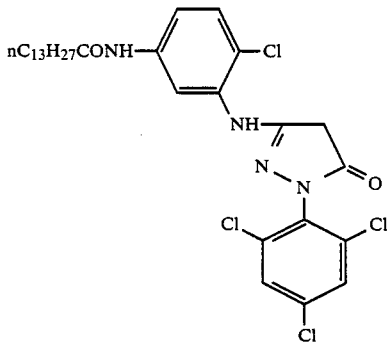

ExC-1

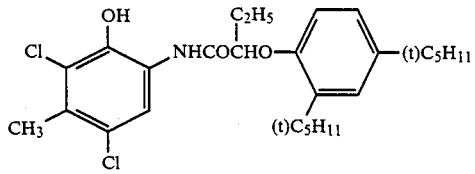

-continued
ExC-2
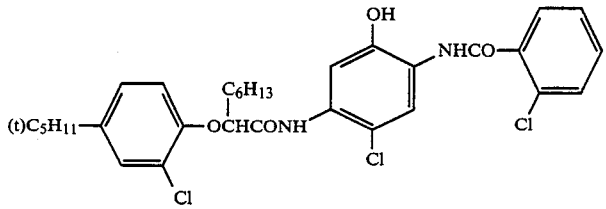
Cpd-1
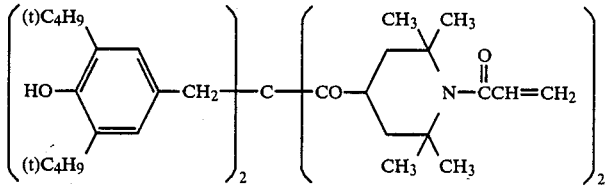
Cpd-2
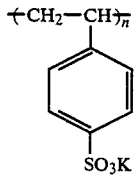
Cpd-3
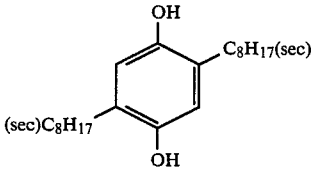
Cpd-4
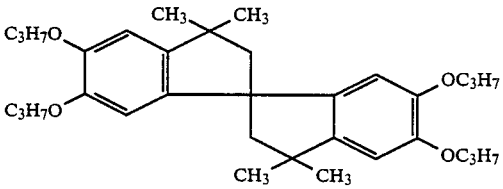
Cpd-5
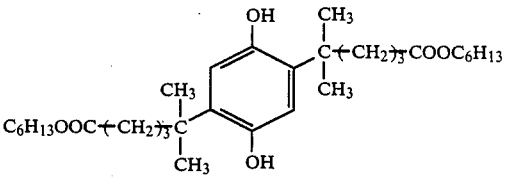
ExS-1
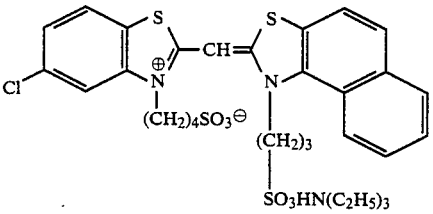
ExS-2
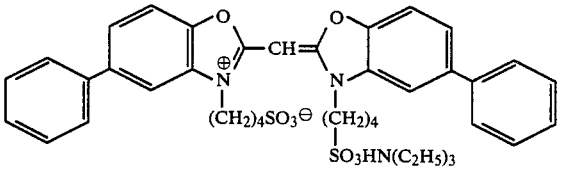

-continued
ExS-3
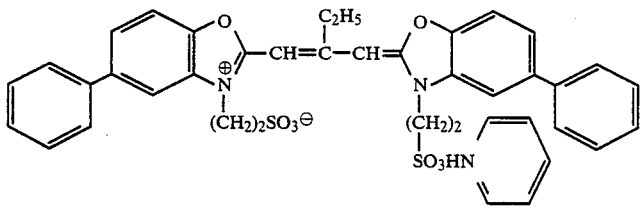
ExS-4
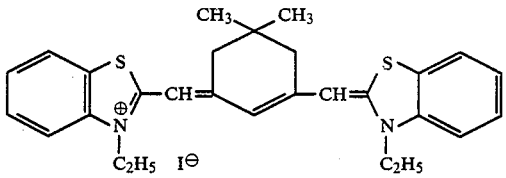
ExS-5
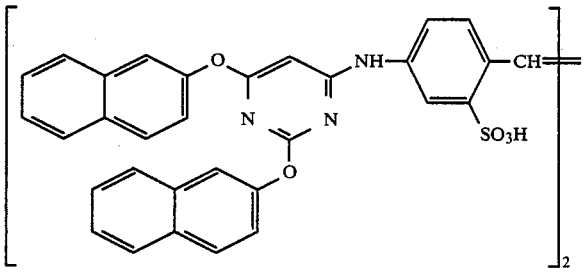
Cpd-6
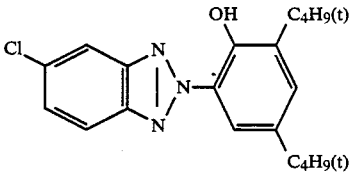
Cpd-7
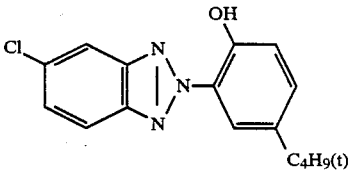
Cpd-8
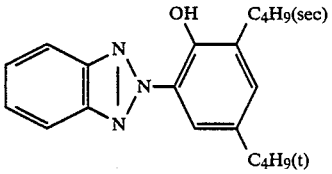
Cpd-9
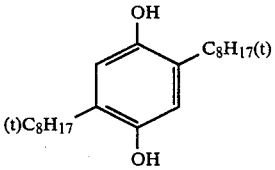
Cpd-10
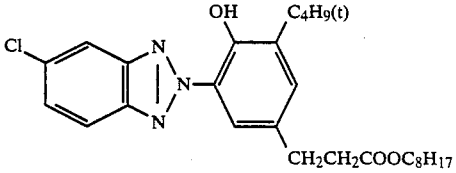
Cpd-11
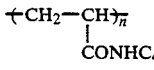
(n = 100~1000)
Molecular weight: 100,000

-continued

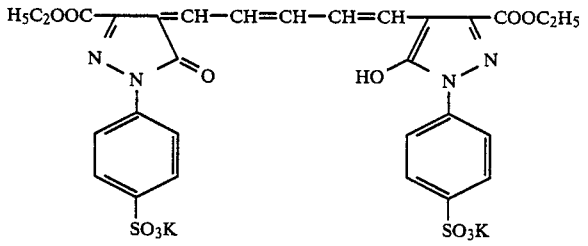

Cpd-12

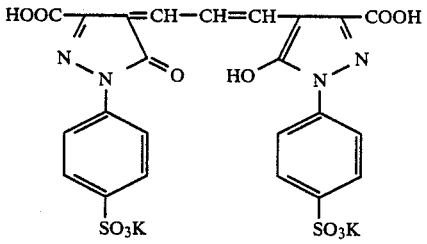

Cpd-13

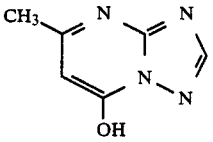

Cpd-14

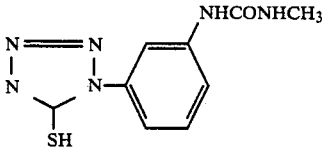

Cpd-15

| | |
|---|---|
| Dibutyl Phthalate | Solv-1 |
| Trioctyl Phosphate | Solv-2 |
| Trinonyl Phosphate | Solv-3 |
| Tricresyl Phosphate | Solv-4 |

Other photographic material samples (3-B) to (3-P) were prepared in the same manner as the sample (3-A), except that the couplers in the fifth layer of the sample (3-A) were replaced by the coupler(s) as indicated in Table 3 below and that the compound of the present invention (see Table 3 below) was added in the same weight as the coupler(s). The thus-prepared samples were processed in accordance with the procedure mentioned below.

| Processing Step | Temperature (°C.) | Time (sec) |
|---|---|---|
| Color Development | 35 | 45 |
| Bleach-Fixation | 30–35 | 45 |
| Rinsing (1) | 30–35 | 20 |
| Rinsing (2) | 30–35 | 20 |
| Rinsing (3) | 30–35 | 20 |
| Rinsing (4) | 30–35 | 30 |
| Drying | 70–80 | 60 |
| (The rinsing step was carried out by four tank-counter-current system from the rinsing bath (4) to the rinsing bath (1).) | | |

| Color Developer: | |
|---|---|
| Water | 800 ml |
| Ethylenediamine-N,N,N,N-tetramethylene-phosphonic Acid | 1.5 g |
| Triethylenediamine(1,4-diazabicyclo-[2,2,2]octane) | 5.0 g |
| Benzyl Alcohol | (See Table 3) |
| Diethylene Glycol | (See Table 3) |
| Sodium Chloride | 1.4 g |
| Potassium Carbonate | 25.0 g |

-continued

| | |
|---|---|
| N-Ethyl-N-(methanesulfonamidoethyl)-3-methyl-4-aminoaniline Sulfate | 5.0 g |
| N,N-Diethylhydroxylamine | 4.2 g |
| Brightening Agent (UVITEX CK, by Ciba Geigy) | 2.0 g |
| Water to make | 1,000 ml |
| pH (25° C.) | 10.10 |
| Bleach-Fixing Solution: | |
| Water | 400 ml |
| Ammonium Thiosulfate (70 wt % aqueous solution) | 100 ml |
| Sodium Sulfite | 18 g |
| Ethylenediaminetetraacetic Acid Iron(III) Ammonium Complex | 55 g |
| Ethylenediaminetetraacetic Acid Disodium Salt | 3 g |
| Ammonium Bromide | 40 g |
| Glacial Acetic Acid | 8 g |
| Water to make | 1,000 ml |
| pH (25° C.) | (See Table 3) |
| Rinsing Solution: | |
| Ion Exchanged Water (calcium and magnesium: each 3 ppm or less) | |

After processing, the maximum density (Dmax) of the cyan color image part was measured by way of the reflection density. Afterwards, the samples were dipped in reagents (CN-16) and (N-2) (manufactured by Fuji Photo Film Co., Ltd.), at 30° C. for 4 minutes whereby the cyan dye (leuco form) was converted back to the coloring dye. Then, the density was again measured, and the coloring potency of the cyan dye was obtained therefrom.

The coloring potency was calculated on the basis of the following formula:

$$\text{Coloring Potency} = \frac{\text{Cyan Density before Reprocessing}}{\text{Cyan Density after Reprocessing}} \times 100$$

TABLE 3

| Sample | Coupler | Additive | BzOH/ Diethylene Glycol (ml/ml) | pH of Bleach-Fixing Solution | Coloring Potency (%) | Residual* Silver Amount ($\mu g/cm^2$) | Note |
|---|---|---|---|---|---|---|---|
| 3-A | ExC-1/ExC-2 | — | 15/10 | 6.5 | 85 | 1.8 | Comparison |
| 3-A | " | — | — | 7.0 | 94 | 7.0 | " |
| 3-A | " | — | — | 6.5 | 88 | 1.9 | " |
| 3-A | " | — | — | 5.5 | 70 | 0.6 | " |
| 3-A | " | — | — | 4.5 | 62 | 0.6 | " |
| 3-A | " | — | — | 3.5 | 58 | 0.7 | " |
| 3-A | " | — | — | 3.0 | 50 | 0.6 | " |
| 3-B | " | I-7 | 15/10 | 6.5 | 90 | 1.2 | Invention |
| 3-B | " | " | — | 7.0 | 98 | 7.1 | " |
| 3-B | " | " | — | 6.5 | 98 | 1.3 | " |
| 3-B | " | " | — | 5.5 | 91 | 0.8 | " |
| 3-B | " | " | — | 4.5 | 89 | 0.6 | " |
| 3-B | " | " | — | 3.5 | 86 | 0.6 | " |
| 3-B | " | " | — | 3.0 | 70 | 0.4 | " |
| 3-C | II-23 | I-8 | — | 5.5 | 92 | 0.6 | " |
| 3-D | " | I-9 | — | 5.5 | 90 | 0.6 | " |
| 3-E | " | I-10 | — | 5.5 | 89 | 0.9 | " |
| 3-F | " | I-13 | — | " | 88 | 0.8 | " |
| 3-G | " | I-16 | — | " | 97 | 0.8 | " |
| 3-H | " | I-33 | — | " | 81 | 0.9 | " |
| 3-I | " | I-37 | — | " | 90 | 0.8 | " |
| 3-J | II-2 | I-7 | — | " | 91 | 0.9 | " |
| 3-K | " | I-8 | — | " | 89 | 0.9 | " |
| 3-L | " | I-9 | — | " | 88 | 0.8 | " |
| 3-M | " | I-10 | — | " | 89 | 0.8 | " |
| 3-N | " | I-8 | — | " | 90 | 0.9 | " |
| 3-O | " | I-16 | — | " | 91 | 0.9 | " |
| 3-P | " | I-37 | — | " | 91 | 0.8 | " |

*The sample was processed in the bleach-fixing bath for 30 seconds and then the amount of the residual silver was measured with a fluorescent X-ray.

As is obvious from the results in Table 3, conversion of the cyan dye into the leuco form is unexpectedly and noticeably suppressed by the addition of a compound of the present invention.

It was also found that the effect was more unexpected and remarkable in the case of using the color developer containing no benzyl alcohol. In addition, the effect was especially remarkable when the pH value of the bleach-fixing solution was within the range of from 3.5 to 6.5. Further, the bleach-fixing solution having the pH value of such a range was confirmed to have a better desilvering potency.

EXAMPLE 4

A multilayer color photographic material sample (No. 101) was prepared by forming the layers each having the composition mentioned below on a cellulose triacetate film support having a subbing layer provided thereon. The layer constitution of each layer was as mentioned below. The amount of the silver halide coated and that of the colloidal silver coated were represented by the unit of $g/m^2$ as silver. The amounts of the coupler, additive and gelatin as coated each were represented by the unit of $g/m^2$. The amount of the sensitizing dye coated was represented by the number of mols per mol of the silver halide in the same layer.

First Layer: Antihalation Layer

-continued

| | |
|---|---|
| Black colloidal silver | 0.2 |
| Gelatin | 1.3 |
| ExM-9 | 0.06 |
| UV-1 | 0.03 |
| UV-2 | 0.06 |
| UV-3 | 0.06 |
| Solv-1 | 0.15 |
| Solv-2 | 0.15 |
| Solv-3 | 0 05 |
| Second Layer: Interlayer | |
| Gelatin | 1.0 |
| UV-1 | 0.03 |
| ExC-4 | 0.02 |
| ExF-1 | 0.004 |
| Solv-1 | 0.1 |
| Solv-2 | 0.1 |
| Third Layer: Low-Sensitive Red-Sensitive Emulsion Layer | |
| Silver iodobromide emulsion (AgI: 4 mol %, uniform AgI type, sphere-corresponding diameter: 0.5 μm, fluctuation coefficient of sphere-corresponding diameter: 20%, tabular grains, aspect ratio of diameter/ thickness: 3.0) | 1.2 as Ag |
| Silver iodobromide emulsion (AgI: 3 mol %, uniform AgI type, sphere-corresponding diameter: 0.3 μm, fluctuation coefficient of sphere-corresponding diameter: 15%, spherical grains, aspect ratio of diameter/ thickness: 1.0) | 0.6 as Ag |
| Gelatin | 1.0 |
| ExS-1 | $4 \times 10^{-4}$ |
| ExS-2 | $5 \times 10^{-5}$ |
| ExC-1 | 0.05 |
| ExC-2 | 0.50 |
| ExC-3 | 0.03 |
| ExC-4 | 0.12 |
| ExC-5 | 0.01 |
| Fourth Layer: High-Sensitive Red-Sensitive Emulsion Layer | |
| Silver iodobromide emulsion (AgI: 6 mol %, core/shell ratio: 1/1, AgI-rich core type, sphere-corresponding | 0.7 as Ag |

-continued

| | |
|---|---|
| diameter: 0.7 μm, fluctuation coefficient of sphere-corresponding diameter: 15%, tabular grains, aspect ratio of diameter/thickness: 5.0) | |
| Gelatin | 1.0 |
| ExS-1 | $3 \times 10^{-4}$ |
| ExS-2 | $2.3 \times 10^{-5}$ |
| ExC-6 | 0.11 |
| ExC-7 | 0.05 |
| ExC-4 | 0.05 |
| Solv-1 | 0.05 |
| Solv-3 | 0.05 |
| Fifth Layer: Interlayer | |
| Gelatin | 0.5 |
| Cpd-1 | 0.1 |
| Solv-1 | 0.05 |
| Sixth Layer: Low-Sensitive Green-Sensitive Emulsion Layer | |
| Silver iodobromide emulsion (AgI: 4 mol %, core/shell ratio: 1/1, AgI-rich shell type, sphere-corresponding diameter: 0.5 μm, fluctuation coefficient of sphere-corresponding diameter: 15% tabular grains, aspect ratio of diameter/thickness: 4.0) | 0.35 as Ag |
| Silver iodobromide emulsion (AgI: 3 mol %, uniform AgI type, sphere-corresponding diameter: 0.3 μm, fluctuation coefficient of sphere-corresponding diameter: 25%, spherical grains, aspect ratio of diameter/thickness: 1.0) | 0.20 as Ag |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |
| Seventh Layer: High-Sensitive Green-Sensitive Emulsion Layer | |
| Silver iodobromide emulsion (AgI: 4 mol %, core/shell ratio: ⅓, AgI-rich core type, sphere-corresponding diameter: 0.7 μm, fluctuation coefficient of sphere-corresponding diameter: 20%, tabular grains, aspect ratio of diameter/thickness: 5.0) | 0.8 as Ag |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |
| ExM-14 | 0.1 |
| Solv-1 | 0.2 |
| Solv-4 | 0.01 |
| Eighth Layer: Interlayer | |
| Gelatin | 0.5 |
| Cpd-1 | 0.05 |
| Solv-1 | 0.02 |
| Ninth Layer: Donor Layer of Interlayer Effect for Red-Sensitive Layer | |
| Silver iodobromide emulsion (AgI: 2 mol %, core/shell ratio: 2/1, AgI-rich core type, sphere-corresponding diameter: 1.0 μm, fluctuation coefficient of sphere-corresponding diameter: 15%, tabular grains, aspect ratio of diameter/thickness: 6.0) | 0.35 as Ag |
| Silver iodobromide emulsion (AgI: 2 mol %, core/shell ratio: 1/1, AgI-rich core type, sphere-corresponding diameter: 0.4 μm, fluctuation coefficient of sphere-corresponding diameter: 20%, tabular grains, aspect ratio of diameter/thickness: 6.0) | 0.20 as Ag |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |
| Tenth Layer: Yellow Filter Layer | |
| Yellow colloidal silver | 0.05 |
| Gelatin | 0.5 |
| Cpd-2 | 0.13 |
| Solv-1 | 0.13 |
| Cpd-1 | 0.10 |
| Eleventh Layer: Low-Sensitive Blue-Sensitive Emulsion Layer | |
| Silver iodobromide emulsion (AgI: 4.5 mol %, uniform AgI type, sphere-corresponding diameter: 0.7 μm, fluctuation coefficient of sphere-corresponding diameter: 15%, tabular grains, aspect ratio of diameter/thickness: 7.0) | 0.3 as Ag |
| Silver iodobromide emulsion (AgI: 3 mol %, uniform AgI type, sphere-corresponding diameter: 0.3 μm, fluctuation coefficient of sphere-corresponding diameter: 25%, tabular grains, aspect ratio of diameter/thickness: 7.0) | 0.15 as Ag |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |
| Twelfth Layer: High-Sensitive Blue-Sensitive Emulsion Layer | |
| Silver iodobromide emulsion (AgI: 10 mol %, AgI-rich core type, sphere-corresponding diameter: 1.0 μm, fluctuation coefficient of sphere-corresponding diameter: 25%, multilayered twin plane tabular grains, aspect ratio of diameter/thickness: 2.0) | 0.5 as Ag |
| Gelatin | 0.5 |
| ExS-6 | $1 \times 10^{-4}$ |
| ExY-15 | 0.20 |
| ExY-13 | 0.01 |
| Solv-1 | 0.10 |
| Thirteenth Layer: First Protective Layer | |
| Gelatin | 0.8 |
| UV-4 | 0.1 |
| UV-5 | 0.15 |
| Solv-1 | 0.01 |
| Solv-2 | 0.01 |
| Fourteenth Layer: Second Protective Layer | |
| Fine silver bromide grain emulsion (AgI: 2 mol %, uniform AgI type, sphere-corresponding diameter: 0.07 μm) | 0.5 |
| Gelatin | 0.45 |
| Polymethyl methacrylate grains (diameter: 1.5 μm) | 0.2 |
| H-1 | 0.4 |
| Cpd-5 | 0.5 |
| Cpd-6 | 0.5 |

Each layer contained emulsion stabilizer (Cpd-3) (0.04 g/m$^2$) and surfactant (Cpd-4) (0.02 g/m$^2$) as coating aids, in addition to the above-mentioned components.

The compounds used in the above-mentioned layers are mentioned below.

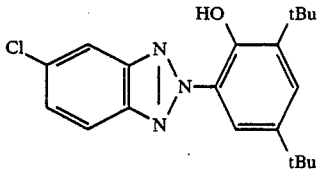
UV-1
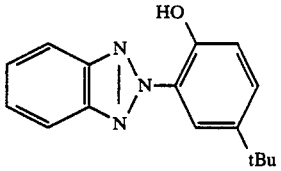
UV-2
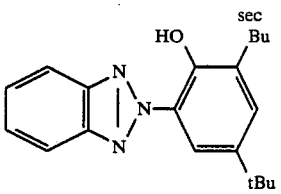
UV-3
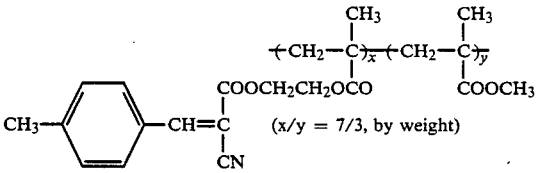
UV-4
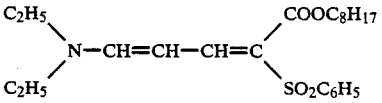
UV-5
Tricresyl Phosphate — Solv-1
Dibutyl Phthalate — Solv-2
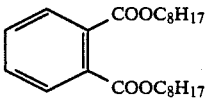
Solv-3
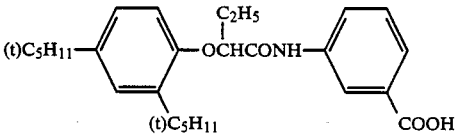
Solv-4
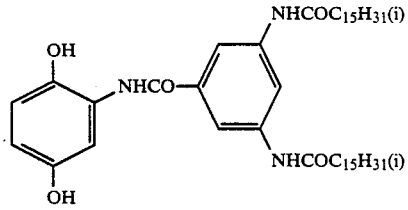
Cpd-1
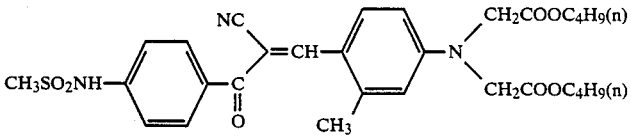
Cpd-2

-continued
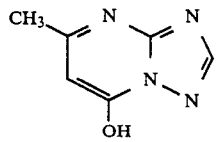
Cpd-3
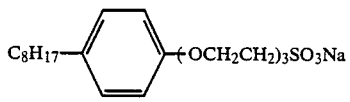
Cpd-4
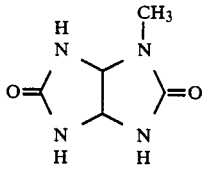
Cpd-5
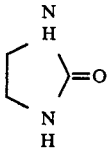
Cpd-6
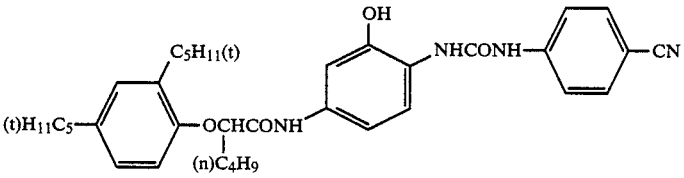
ExC-1
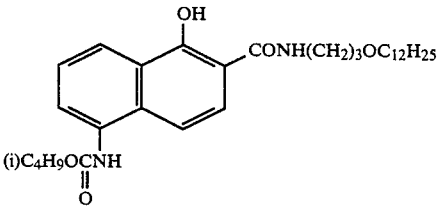
ExC-2
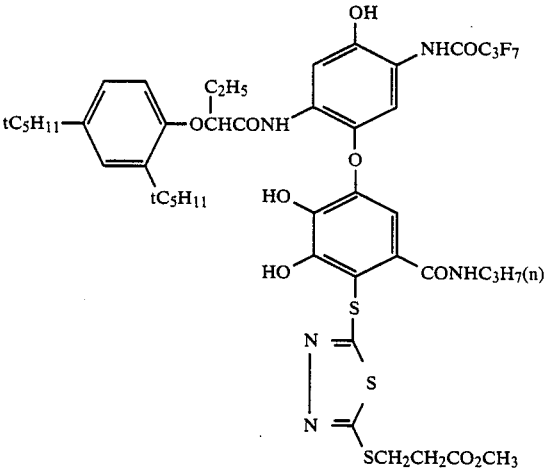
ExC-3

-continued
ExC-4
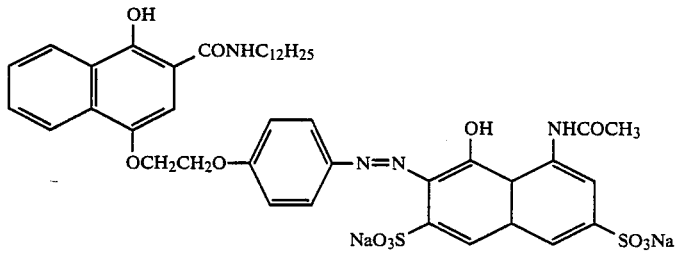
ExC-5
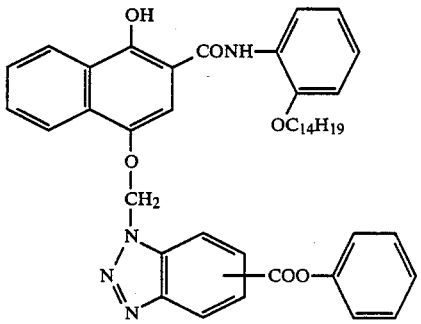
ExC-6
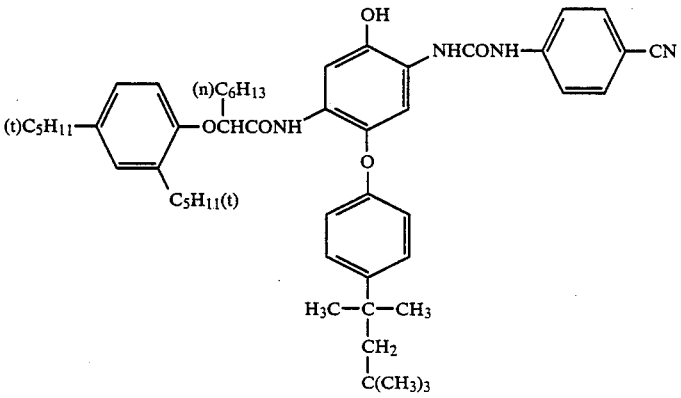
ExC-7
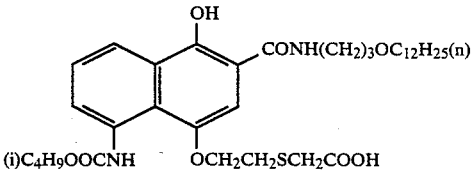
ExM-8
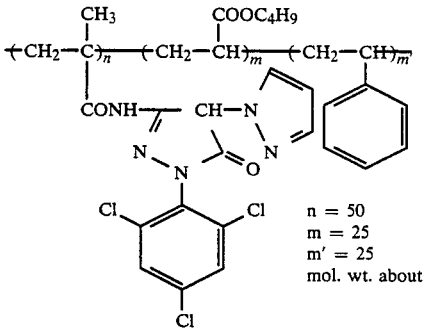
n = 50
m = 25
m' = 25
mol. wt. about 20,000

-continued
ExM-9
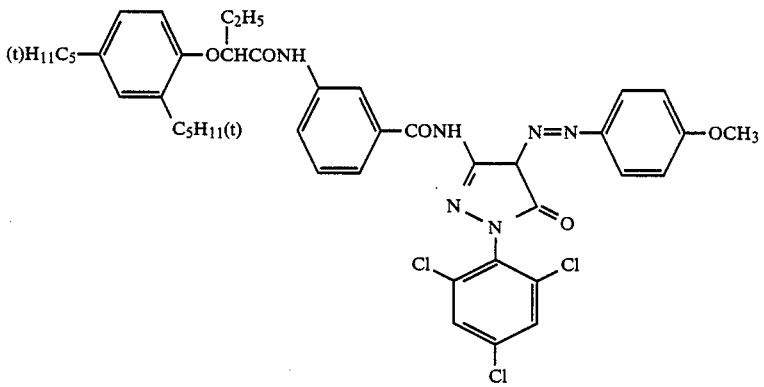
ExM-10
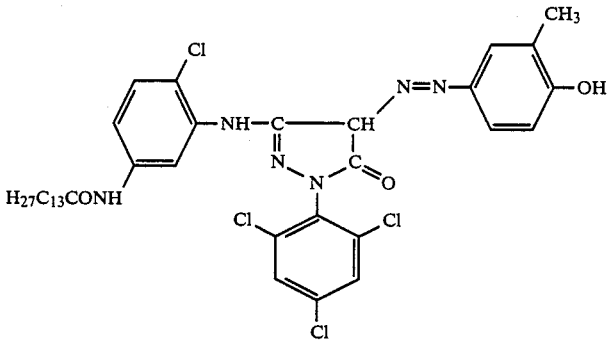
ExY-11
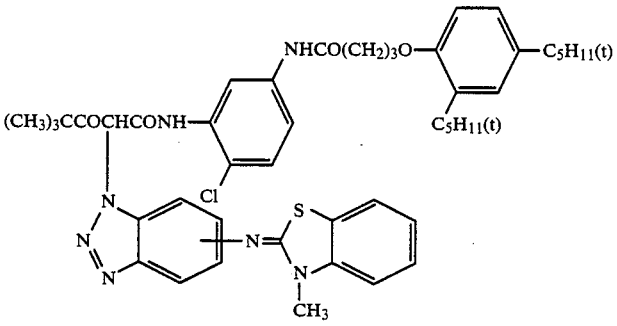
ExM-12
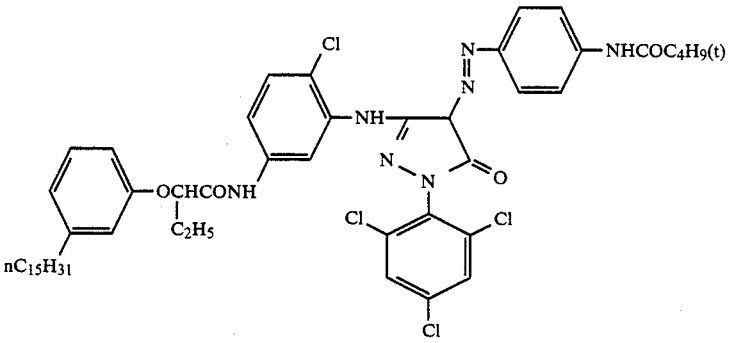

-continued
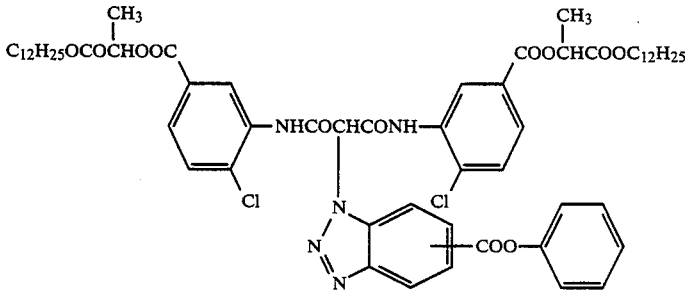
ExY-13
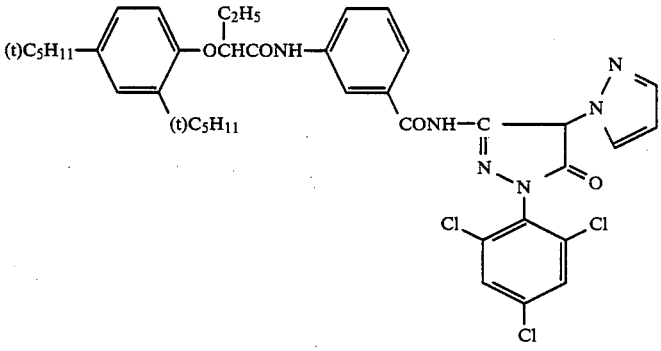
ExM-14
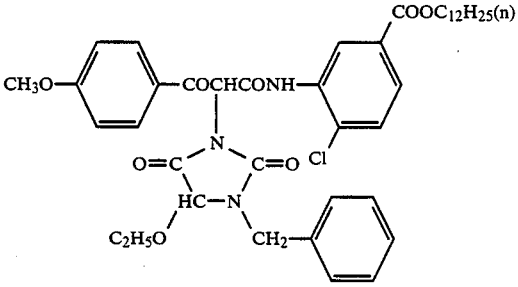
ExY-15
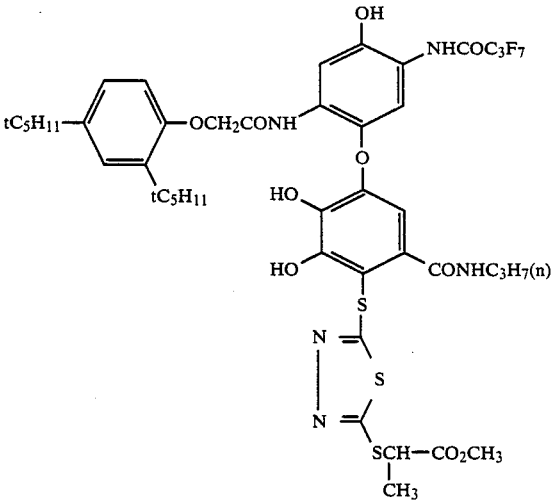
ExC-16
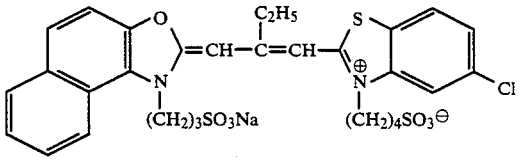
ExS-1

-continued

ExS-2

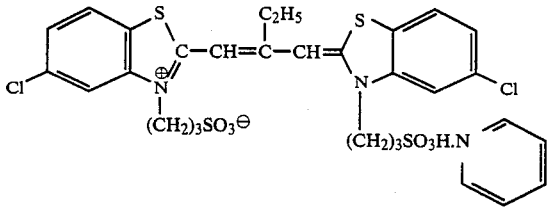

ExS-3

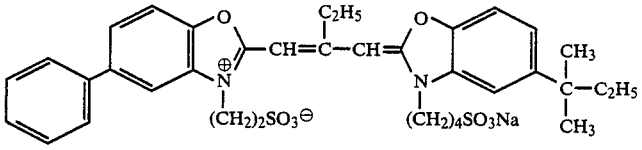

ExS-4

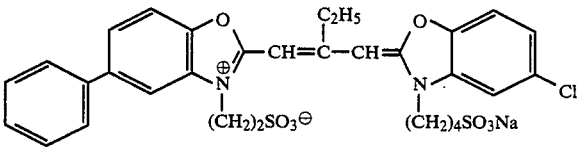

ExS-5

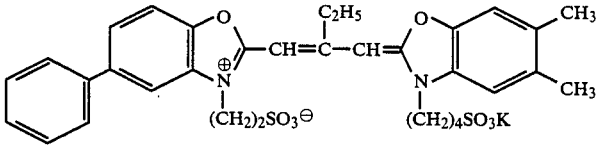

ExS-6

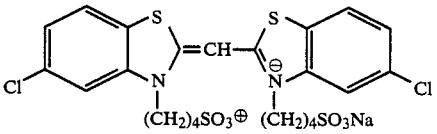

H-1

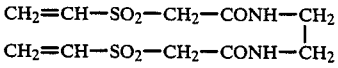

ExF-1

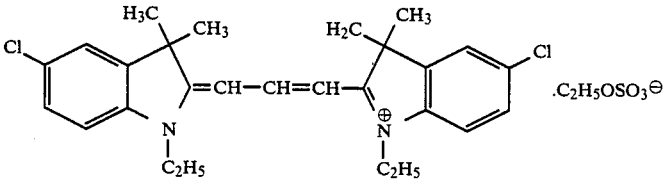

Photographic material samples (4-B) to (4-H) were prepared in the same manner as Sample (4-A), except that the compound of the present invention (as indicated in Table 4 below) was added to the third layer and fourth layer in the same weight of the couplers used therein. The samples were processed in accordance with the procedure indicated below.

Specifically, the samples were exposed and then processed in accordance with the process mentioned below (until the total amount of the replenisher used became three times of the volume of the capacity of the tank having the mother processing solution), using Color Negative Processor FP-350 (manufactured by Fuji Photo Film Co., Ltd.).

Processing Procedure:

| Step | Processing Time | Processing Temperature (°C.) | Amount of Replenisher (ml) | Capacity of Tank (liter) |
|---|---|---|---|---|
| Color Development | 3 min 15 sec | 38 | 45 | 10 |
| Bleaching | 1 min 00 sec | 38 | 20 | 4 |
| Bleach-Fixation | 3 min 15 sec | 38 | 30 | 10 |
| Rinsing (1) | 40 sec | 35 | (counter-current system from rinsing bath (2) to rinsing bath (1)) | 4 |
| Rinsing (2) | 1 min 00 sec | 35 | 30 | 4 |
| Stabilization | 40 sec | 38 | 20 | 4 |

-continued

| Processing Procedure: | | | | |
|---|---|---|---|---|
| Step | Processing Time | Processing Temperature (°C.) | Amount of Replenisher (ml) | Capacity of Tank (liter) |
| Drying | 1 min 15 sec | 55 | | |

(Amount of replenisher was per m of 35 mm-wide sample.)

In the above-mentioned processing procedure, the amount of the bleach-fixing solution as brought into the rinsing step together with the sample being processed was 2 ml per m of the 35 mm-wide sample.

The compositions of the respective processing solutions used were as follows:

| Color Developer: | Mother Solution (g) | Replenisher (g) |
|---|---|---|
| Diethylenetriaminepentaacetic Acid | 1.0 | 1.1 |
| 1-Hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-(N-Ethyl-N-β-hydroxyethylamino)-2-methylaniline Sulfate | 4.5 | 5.5 |
| Water to make | 1.0 l | 1.0 l |
| pH | 10.05 | 10.10 |

| Bleaching Solution: (Mother solution and replenisher were the same.) | |
|---|---|
| Ethylenediaminetetraacetic Acid Ferric Ammonium Complex Dihydrate | 120.0 g |
| Ethylenediaminetetraacetic Acid Disodium Salt | 10.0 g |
| Ammonium Bromide | 100.0 g |
| Ammonium Nitrate | 10.0 g |
| Bleaching Accelerator | 0.005 mol |

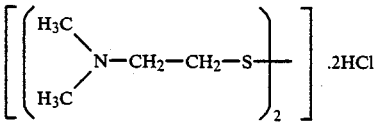

| | |
|---|---|
| Aqueous Ammonia (27 wt %) | 15.0 ml |
| Water to make | 1.0 liter |
| pH | 6.3 |

| Bleach-Fixing Solution: (Mother solution and replenisher were the same.) | |
|---|---|
| Ethylenediaminetetraacetic Acid Ferric Ammonium Complex Dihydrate | 50.0 g |
| Ethylenediaminetetraacetic Acid Disodium Salt | 5.0 g |
| Sodium Sulfite | 12.0 g |
| Ammonium Thiosulfate (aqueous solution, 70 wt %) | 240 ml |
| Aqueous Ammonia (27 wt %) | 6.0 ml |
| Water to make | 1.0 liter |
| pH | 7.2 |

Rinsing Solution: (Mother solution and replenisher were the same.)

A tap water was passed through a mixing bed column filled with an H-type strong acidic cation exchange resin (Amberlite IR-120B, by Rohm & Haas Co.) and an OH type anion exchange resin (Amberlite IR-400, by Rohm & Haas Co.) so that the calcium concentration and magnesium concentration each were reduced to 3 mg/liter or less, and then sodium dichloroisocyanurate (20 mg/liter) and sodium sulfate (150 mg/liter) were added thereto. The solution had a pH value within the range of from 6.5 to 7.5.

| Stabilizing Solution: (Mother solution and replenisher were the same.) | |
|---|---|
| Formaldehyde (37 wt %) | 2.0 ml |
| Polyoxyethylene-p-monononylphenylether (average polymerization degree: 10) | 0.3 g |
| Ethylenediaminetetraacetic Acid Disodium Salt | 0.05 g |
| Water to make | 1.0 liter |
| pH | 5.0 to 8.0 |

Immediately after processing, the yellow transmission density in the nonexposed part was measured. Then, the samples were exposed to a 15,000 lux fluorescent lamp for 14 days, and the yellow transmission density of the nonexposed part was again measured in each sample (fading test).

The increase of the stain in the sample after the fading test was calculated and shown in Table 4 below.

TABLE 4

| Sample | Additive | Increase of Stain | Note |
|---|---|---|---|
| 4-A | — | +0.22 | Comparison |
| 4-B | I-7 | +0.10 | Invention |
| 4-C | I-8 | +0.11 | " |
| 4-D | I-9 | +0.09 | " |
| 4-E | I-10 | +0.09 | " |
| 4-F | I-13 | +0.10 | " |
| 4-G | I-16 | +0.10 | " |
| 4-H | I-33 | +0.10 | " |

As is obvious from the results in Table 4, the compounds of the present invention (additive in Table 4) were unexpectedly and noticeably effective for suppressing the increase of stain in the photographic material samples after exposure to light.

EXAMPLE 5

The same process as in Example 1 was repeated that the Solv-1 in the first layer of the samples was replaced by the same weight of the compound of the present invention (Compound I-7 to Compound I-37). The thus-prepared samples also showed the same results.

EXAMPLE 6

The same process as in Example 3 was repeated except that the Solv-1 in the fifth layer of the samples was replaced by the same weight of the compound of the present invention (Compound I-7 to Compound I-37). The thus-prepared samples also showed the same results.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic material containing a color coupler and comprising a support having thereon at least one hydrophilic colloid layer containing at least one high boiling point organic solvent and at least one substantially water-insoluble photographically useful reagent both dispersed therein, wherein at least one of said high boiling point organic solvents is a compound represented by formula (I):

$$(ArCOO)_n—L \quad (I)$$

wherein Ar represents an aryl group having from 6 to 24 carbon atoms; L represents a 2- to 6-valent alkylene group having from 2 to 24 carbon atoms which may contain one or more ether bonds; and n represents an integer of from 2 to 6, wherein said method comprises imagewise exposing said material and then developing said material with a color developer which is an aqueous alkaline solution consisting essentially of an aromatic primary amine color developing agent and which is substantially free of benzyl alcohol.

2. The method of claim 1, wherein L is a group selected from the group consisting of the formulae (I-1) to (I-9):

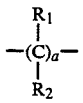
(I-1)

wherein $R_1$ and $R_2$ independently represent a hydrogen atom or an alkyl group having from 1 to 12 carbon atoms; and a represents an integer of from 2 to 12, provided that $R_1$ and $R_2$ may be bonded together to form a cycloalkane, or plural

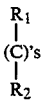

may be the same or different;

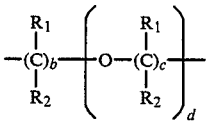
(I-2)

wherein

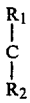

has the same meaning as defined in formula (I-1); b and c independently represent an integer of from 2 to 6; and d represents an integer of from 1 to 8;

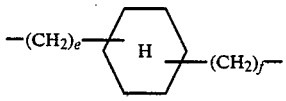
(I-3)

wherein

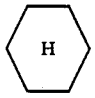

represents a cyclohexane ring; and e and f independently represent an integer of from 0 to 4;

$$—(CH_2)_g—A—(CH_2)_h— \quad (I-4)$$

wherein A represents a hydrocarbon ring other than cyclohexane; and g and h independently represents an integer of from 0 to 4;

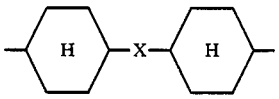
(I-5)

wherein

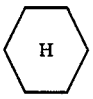

represents a cyclohexane ring; X represents

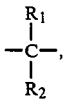

—O—, $—SO_2—$, —SO—, —S— or —CO—, wherein

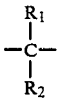

has the same meaning as defined in formula (I-1);

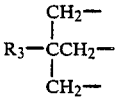
(I-6)

wherein $R_3$ represents a hydrogen atom, an alkyl group having from 1 to 6 carbon atoms or $ArCOOCH_2$— wherein Ar has the same meaning as defined in formula (I);

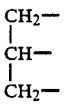
(I-7)

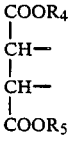
(I-8)

wherein $R_4$ and $R_5$ independently represent an alkyl group having from 1 to 10 carbon atoms; and

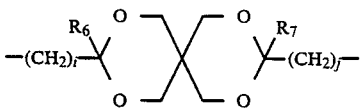

(I-9)

wherein $R_6$ and $R_7$ independently represents a hydrogen atom or an alkyl group having from 1 to 6 carbon atoms; and i and j independently represent an integer of from 1 to 6.

3. The method of claim 2, wherein L is represented by a group selected from the group of formulae consisting of (I-3), (I-4), (I-5), (I-6) and (I-9).

4. The method of any one of claims 2 or 3, wherein L is represented by a group selected from the group of formulae consisting of (I-4), (I-5), (I-6) and (I-9).

5. The method of claim 1, wherein Ar represents an unsubstituted phenyl group, a 1-naphthyl group, a 2-naphthyl group, or a phenyl group substituted by one or more substituents selected from the group consisting of an alkyl group, an alkoxy group and a halogen atom.

6. The method of claim 5, wherein Ar represents an unsubstituted phenyl group.

7. The method of claim 1, wherein at least one of the substantially water-insoluble photographically useful reagent is a cyan coupler represented by the formula (II):

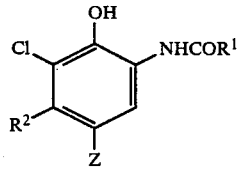

(II)

wherein $R^1$ represents an aliphatic group, an aromatic group or a heterocyclic group; $R^2$ represents an alkyl group having from 1 to 15 carbon atoms; Z represents a hydrogen atom or a group or atom capable of being released by coupling reaction with a developing agent.

8. The method of claim 1, wherein at least one of the substantially water-insoluble photographically useful reagent is a cyan coupler represented by formula (III):

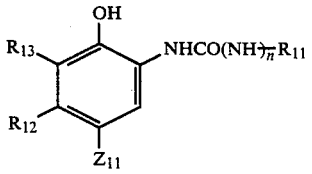

(III)

wherein $R_{11}$ represents an aliphatic group, an aromatic group or a heterocyclic group; $R_{12}$ represents a methyl group or an acylamino group; $R_{13}$ represents a hydrogen atom, a halogen atom, an aliphatic group, an aromatic group, an aliphatic or aromatic oxy group or an acylamino group, provided that $R_{12}$ and $R_{13}$ may be bonded together to form a 5- to 7-membered ring; $Z_{11}$ represents a hydrogen atom or a group or atom capable of being released by oxidative coupling with a developing agent; p represents 0 or 1.

9. The method of claim 1, wherein at least one of the substantially water-insoluble photographically useful reagent is a yellow coupler selected from those represented by formula (IV) and (V):

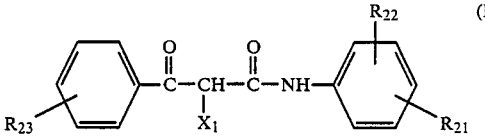

(IV)

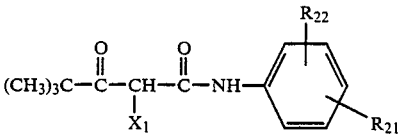

(V)

wherein $X_1$ represents a hydrogen atom or a coupling-releasing group; $R_{21}$ represents a nondiffusible group having a total of from 8 to 32 carbon atoms; $R_{22}$ represents a hydrogen atom, a halogen atom, a lower alkyl group, a lower alkoxy group or a nondiffusible group having a total of from 8 to 32 carbon atoms, provided that there can be plural $R_{22}$'s and which can be the same or different; $R_{23}$ represents a hydrogen atom or a substituent, provided that there can be plural $R_{23}$'s which may be the same or different.

10. The method of claim 1, wherein at least one of the substantially water-insoluble photographically useful reagent is a magenta coupler selected from formulae (VI), (VII) and (VIII):

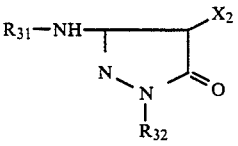

(VI)

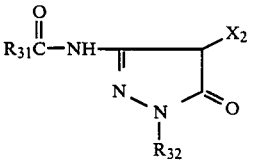

(VII)

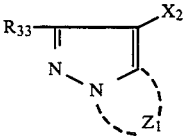

(VIII)

wherein $R_{31}$ represents a nondiffusible group having a total of from 8 to 32 carbon atom; $R_{32}$ represents a phenyl group or a substituted phenyl group; $R_{33}$ represents a hydrogen atom or a substituent; $Z_1$ represents a nonmetallic atomic group necessary for forming a 5-membered azole ring having from 2 to 4 nitrogen atoms; and $X_2$ represents a hydrogen atom or a group or atom capable of being released by coupling reaction with a developing agent.

11. The method of claim 7, wherein the cyan coupler is a compound represented by formula (II), wherein $R_1$ is a substituted or unsubstituted alkyl group having at least 8 total carbon atoms and $R_2$ is an alkyl group having from 1 to 4 carbon atoms and Z is a hydrogen atom or a halogen atom.

12. The method of claim 7, wherein the cyan coupler is a compound represented by formula (II) wherein $R_1$ is a substituted or unsubstituted alkyl group having sufficient carbon atoms to render the coupler difficultly diffusible in a hydrophilic colloid layer and $R_2$ is a methyl group and Z is a hydrogen atom or a halogen atom.

13. The method of claim 1, wherein the hydrophilic colloid layer is a silver halide light-sensitive emulsion layer.

14. The method of claim 1, wherein said silver halide photographic material comprises a support having thereon at least one hydrophilic colloid layer containing at least one high boiling point organic solvent and at least one substantially water-insoluble photographically useful reagent both dispersed therein, wherein at least one of said high boiling point organic solvents is a compound represented by formula (I):

$$(ArCOO)_n—L \quad (I)$$

wherein Ar represents an unsubstituted phenyl group; a 1-naphthyl group, a 2-naphthyl group, or a phenyl group substituted by one or more substituents selected from the group consisting of an alkyl group, an alkoxy group and a halogen atom; L represents a 2- to 6-valent alkylene group having from 2 to 24 carbon atoms which may contain one or more ether bonds; and n represents an integer of from 2 to 6.

* * * * *